US008790439B2

(12) United States Patent
Mirchandani et al.

(10) Patent No.: US 8,790,439 B2
(45) **Date of Patent: *Jul. 29, 2014**

(54) COMPOSITE SINTERED POWDER METAL ARTICLES

(75) Inventors: Prakash K. Mirchandani, Houston, TX (US); Morris E. Chandler, Santa Fe, TX (US)

(73) Assignee: Kennametal Inc., Latrobe, PA (US)

( * ) Notice: Subject to any disclaimer, the term of this patent is extended or adjusted under 35 U.S.C. 154(b) by 40 days.

This patent is subject to a terminal disclaimer.

(21) Appl. No.: 13/558,769

(22) Filed: Jul. 26, 2012

(65) Prior Publication Data

US 2012/0285293 A1 Nov. 15, 2012

Related U.S. Application Data

(60) Continuation-in-part of application No. 13/487,323, filed on Jun. 4, 2012, which is a division of application No. 12/476,738, filed on Jun. 2, 2009, now Pat. No. 8,221,517.

(60) Provisional application No. 61/057,885, filed on Jun. 2, 2008.

(51) Int. Cl.
*B32B 15/02* (2006.01)
*B23C 5/00* (2006.01)

(52) U.S. Cl.
USPC ..... 75/247

(58) Field of Classification Search
USPC ..... 75/246, 247
See application file for complete search history.

(56) References Cited

U.S. PATENT DOCUMENTS 1,509,438 A 9/1924 Miller
1,530,293 A 3/1925 Breitenstein (Continued)

FOREIGN PATENT DOCUMENTS

AU 695583 2/1998
CA 1018474 A 10/1977

(Continued)

OTHER PUBLICATIONS

Nassau, K. Ph.D. and Julia Nassau, "The History and Present Status of Synthetic Diamond, Part I and II", reprinted from The Lapidary Journal, Inc., vol. 32, No. 1, Apr. 1978; vol. 32, No. 2, May 1978, 15 pages.

(Continued)

*Primary Examiner* — George Wyszomierski
*Assistant Examiner* — Tima M McGuthry Banks
(74) *Attorney, Agent, or Firm* — Matthew W. Gordon, Esq.

(57) ABSTRACT

A composite sintered powder metal article including a first region including a cemented hard particle material such as, for example, cemented carbide. The article includes a second region including: a metallic material selected from a steel, nickel, a nickel alloy, titanium, a titanium alloy, molybdenum, a molybdenum alloy, cobalt, a cobalt alloy, tungsten, a tungsten alloy; and from 0 up to 30 percent by volume of hard particles. The first region is metallurgically bonded to the second region, and each of the first region and the second region has a thickness of greater than 100 microns. The second region comprises at least one mechanical attachment feature so that the composite sintered powder metal article can be attached to another article. The article comprises one of an earth boring article, a metalcutting tool, a metalforming tool, a woodworking tool, and a wear article.

43 Claims, 10 Drawing Sheets

(56) References Cited

U.S. PATENT DOCUMENTS 1,808,138 A 6/1931 Hogg et al.
1,811,802 A 6/1931 Newman
1,912,298 A 5/1933 Newman
2,054,028 A 9/1936 Benninghoff
2,093,507 A 9/1937 Bartek
2,093,742 A 9/1937 Staples
2,093,986 A 9/1937 Staples
2,113,354 A * 4/1938 McKenna ..... 423/440
2,240,840 A 5/1941 Fischer
2,246,237 A 6/1941 Benninghoff
2,283,280 A 5/1942 Nell
2,299,207 A 10/1942 Bevillard
2,351,827 A 6/1944 McAllister
2,422,994 A 6/1947 Taylor
2,819,958 A 1/1958 Abkowitz et al.
2,819,959 A 1/1958 Abkowitz et al.
2,906,654 A 9/1959 Abkowitz
2,954,570 A 10/1960 Couch
3,041,641 A 7/1962 Hradek et al.
3,093,850 A 6/1963 Kelso
3,368,881 A 2/1968 Abkowitz et al.
3,471,921 A 10/1969 Feenstra
3,482,295 A 12/1969 Trent
3,490,901 A 1/1970 Hachisuka et al.
3,581,835 A 6/1971 Stebley
3,609,849 A 10/1971 Krol
3,629,887 A 12/1971 Urbanic
3,660,050 A 5/1972 Iler et al.
3,757,879 A 9/1973 Wilder et al.
3,762,882 A 10/1973 Grutza
3,776,655 A 12/1973 Urbanic
3,782,848 A 1/1974 Pfeifer
3,806,270 A 4/1974 Tanner et al.
3,812,548 A 5/1974 Theuerkaue
3,855,444 A 12/1974 Palena
3,889,516 A 6/1975 Yankee et al.
RE28,645 E 12/1975 Aoki et al.
3,936,295 A 2/1976 Cromwell et al.
3,942,954 A 3/1976 Frehn
3,980,549 A 9/1976 Grutza
3,987,859 A 10/1976 Lichte
4,009,027 A 2/1977 Naidich et al.
4,017,480 A 4/1977 Baum
4,047,828 A 9/1977 Makely
4,094,709 A 6/1978 Rozmus
4,097,180 A 6/1978 Kwieraga
4,097,275 A 6/1978 Horvath
4,105,049 A 8/1978 Anderson
4,106,382 A 8/1978 Salje et al.
4,126,652 A 11/1978 Oohara et al.
4,128,136 A 12/1978 Generoux
4,170,499 A 10/1979 Thomas et al.
4,181,505 A 1/1980 De Vries et al.
4,198,233 A 4/1980 Frehn
4,221,270 A 9/1980 Vezirian
4,229,638 A 10/1980 Lichte
4,233,720 A 11/1980 Rozmus
4,255,165 A 3/1981 Dennis et al.
4,270,952 A 6/1981 Kobayashi
4,276,788 A 7/1981 van Nederveen
4,277,106 A 7/1981 Sahley
4,277,108 A 7/1981 Wallace
4,306,139 A 12/1981 Shinozaki et al.
4,311,490 A 1/1982 Bovenkerk et al.
4,325,994 A 4/1982 Kitashima et al.
4,327,156 A 4/1982 Dillon et al.
4,331,741 A 5/1982 Wilson
4,340,327 A 7/1982 Martins
4,341,557 A 7/1982 Lizenby
4,351,401 A 9/1982 Fielder
4,376,793 A 3/1983 Jackson
4,389,952 A 6/1983 Dreier et al.
4,396,321 A 8/1983 Holmes
4,398,952 A 8/1983 Drake
4,423,646 A 1/1984 Bernhardt
4,478,297 A 10/1984 Radtke
4,497,358 A 2/1985 Gnadig et al.
4,499,048 A 2/1985 Hanejko
4,499,795 A 2/1985 Radtke
4,520,882 A 6/1985 van Nederveen
4,526,748 A 7/1985 Rozmus
4,547,104 A 10/1985 Holmes
4,547,337 A 10/1985 Rozmus
4,550,532 A 11/1985 Fletcher, Jr. et al.
4,552,232 A 11/1985 Frear
4,553,615 A 11/1985 Grainger
4,554,130 A 11/1985 Ecer
4,562,990 A 1/1986 Rose
4,574,011 A 3/1986 Bonjour et al.
4,579,713 A 4/1986 Lueth
4,587,174 A 5/1986 Yoshimura et al.
4,592,685 A 6/1986 Beere
4,596,694 A 6/1986 Rozmus
4,597,456 A 7/1986 Ecer
4,597,730 A 7/1986 Rozmus
4,604,106 A 8/1986 Hall
4,604,781 A 8/1986 Rankin, III
4,605,343 A 8/1986 Hibbs, Jr. et al.
4,609,577 A 9/1986 Long
4,630,693 A 12/1986 Goodfellow
4,642,003 A 2/1987 Yoshimura
4,646,857 A 3/1987 Thompson
4,649,086 A 3/1987 Johnson
4,656,002 A 4/1987 Lizenby et al.
4,662,461 A 5/1987 Garrett
4,667,756 A 5/1987 King et al.
4,686,080 A 8/1987 Hara et al.
4,686,156 A 8/1987 Baldoni, II et al.
4,694,919 A 9/1987 Barr
4,708,542 A 11/1987 Emanuelli
4,722,405 A 2/1988 Langford
4,729,789 A 3/1988 Ide et al.
4,734,339 A 3/1988 Schachner et al.
4,735,656 A 4/1988 Schaefer et al.
4,743,515 A 5/1988 Fischer et al.
4,744,943 A 5/1988 Timm
4,749,053 A 6/1988 Hollingshead
4,752,159 A 6/1988 Howlett
4,752,164 A 6/1988 Leonard, Jr.
4,761,844 A 8/1988 Turchan
4,779,440 A 10/1988 Cleve et al.
4,780,274 A 10/1988 Barr
4,804,049 A 2/1989 Barr
4,809,903 A 3/1989 Eylon et al.
4,813,823 A 3/1989 Bieneck
4,831,674 A 5/1989 Bergstrom et al.
4,838,366 A 6/1989 Jones
4,861,350 A 8/1989 Phaal et al.
4,871,377 A 10/1989 Frushour
4,881,431 A 11/1989 Bieneck
4,884,477 A 12/1989 Smith et al.
4,887,496 A * 12/1989 Kobayashi ..... 76/108.1
4,889,017 A 12/1989 Fuller et al.
4,899,838 A 2/1990 Sullivan et al.
4,919,013 A 4/1990 Smith et al.
4,923,512 A 5/1990 Timm et al.
4,934,040 A 6/1990 Turchan
4,943,191 A 7/1990 Schmitt
4,956,012 A 9/1990 Jacobs et al.
4,968,348 A 11/1990 Abkowitz et al.
4,971,485 A 11/1990 Nomura et al.
4,991,670 A 2/1991 Fuller et al.
5,000,273 A 3/1991 Horton et al.
5,010,945 A 4/1991 Burke
5,024,563 A * 6/1991 Randall ..... 408/1 R
5,030,598 A 7/1991 Hsieh
5,032,352 A 7/1991 Meeks et al.
5,041,261 A 8/1991 Buljan et al.
5,049,450 A 9/1991 Dorfman et al.
RE33,753 E 11/1991 Vacchiano et al.
5,067,860 A 11/1991 Kobayashi et al.
5,075,315 A 12/1991 Rasmussen
5,075,316 A 12/1991 Hubele
5,080,538 A 1/1992 Schmitt

(56) References Cited

U.S. PATENT DOCUMENTS 5,090,491 A 2/1992 Tibbitts et al.
5,092,412 A 3/1992 Walk
5,094,571 A 3/1992 Ekerot
5,096,465 A 3/1992 Chen et al.
5,098,232 A 3/1992 Benson
5,110,687 A 5/1992 Abe et al.
5,112,162 A 5/1992 Hartford et al.
5,112,168 A 5/1992 Glimpel
5,116,659 A 5/1992 Glatzle et al.
5,126,206 A 6/1992 Garg et al.
5,127,776 A 7/1992 Glimpel
5,135,801 A 8/1992 Nyström et al.
5,161,898 A 11/1992 Drake
5,167,067 A 12/1992 Sundstedt et al.
5,174,700 A 12/1992 Sgarbi et al.
5,179,772 A 1/1993 Braun et al.
5,186,739 A 2/1993 Isobe et al.
5,203,513 A 4/1993 Keller et al.
5,203,932 A 4/1993 Kato et al.
5,217,081 A 6/1993 Waldenström et al.
5,232,522 A 8/1993 Doktycz et al.
5,250,355 A 10/1993 Newman et al.
5,266,415 A 11/1993 Newkirk et al.
5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,335,738 A 8/1994 Waldenström et al.
5,338,135 A 8/1994 Noguchi et al.
5,346,316 A 9/1994 Okada et al.
5,348,806 A 9/1994 Kojo et al.
5,354,155 A 10/1994 Adams
5,359,772 A 11/1994 Carlsson et al.
5,373,907 A 12/1994 Weaver
5,376,329 A 12/1994 Morgan et al.
5,413,438 A 5/1995 Turchan
5,423,899 A 6/1995 Krall et al.
5,429,459 A 7/1995 Palm
5,433,280 A 7/1995 Smith
5,438,108 A 8/1995 Umemura et al.
5,438,858 A 8/1995 Friedrichs
5,443,337 A 8/1995 Katayama
5,447,549 A 9/1995 Yoshimura
5,452,771 A 9/1995 Blackman et al.
5,467,669 A 11/1995 Stroud
5,474,407 A 12/1995 Rodel et al.
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,492,186 A 2/1996 Overstreet et al.
5,496,137 A 3/1996 Ochayon et al.
5,498,142 A 3/1996 Mills
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,238 A 10/1996 Allebach et al.
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,286 A 3/1997 Anthon
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,672,382 A 9/1997 Lux
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,704,736 A 1/1998 Giannetti
5,712,030 A 1/1998 Goto et al.
5,718,948 A 2/1998 Ederyd et al.
5,732,783 A 3/1998 Truax et al.
5,733,078 A 3/1998 Matsushita et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Gunter et al.
5,755,298 A 5/1998 Langford, Jr. et al.
5,762,843 A 6/1998 Massa et al.
5,765,095 A 6/1998 Flak et al.
5,776,593 A 7/1998 Massa et al.
5,778,301 A 7/1998 Hong
5,782,403 A 7/1998 Wang
5,789,686 A * 8/1998 Massa et al. ..... 75/240
5,791,833 A 8/1998 Niebauer
5,792,403 A 8/1998 Massa et al.
5,803,152 A 9/1998 Dolman et al.
5,806,934 A 9/1998 Massa et al.
5,830,256 A 11/1998 Northrop et al.
5,851,094 A 12/1998 Strand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A 3/1999 Fang et al.
5,890,852 A 4/1999 Gress
5,893,204 A 4/1999 Symonds
5,897,830 A 4/1999 Abkowitz et al.
5,899,257 A 5/1999 Alleweireldt et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
5,989,731 A 11/1999 Arisawa et al.
6,007,909 A 12/1999 Rolander et al.
6,012,882 A 1/2000 Turchan
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Gunter et al.
6,086,980 A 7/2000 Foster et al.
6,089,123 A 7/2000 Chow et al.
6,109,377 A 8/2000 Massa et al.
6,109,677 A 8/2000 Anthony
6,117,493 A 9/2000 North
6,135,218 A 10/2000 Deane et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,247 B1 4/2001 Leverenz et al.

(56) References Cited

U.S. PATENT DOCUMENTS 6,214,287 B1 4/2001 Waldenström
6,217,992 B1 4/2001 Grab
6,220,117 B1 4/2001 Butcher
6,227,188 B1 5/2001 Tankala et al.
6,228,134 B1 5/2001 Erickson
6,228,139 B1 5/2001 Oskarsson
6,234,261 B1 5/2001 Evans et al.
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,302,224 B1 10/2001 Sherwood, Jr.
6,326,582 B1 12/2001 North
6,345,941 B1 2/2002 Fang et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,394,711 B1 5/2002 Brosius
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,475,647 B1 11/2002 Mendez Acevedo et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,541,124 B1 4/2003 Suggs
6,544,308 B2 4/2003 Griffin et al.
6,546,991 B2 4/2003 Dworog et al.
6,551,035 B1 4/2003 Bruhn et al.
6,554,548 B1 4/2003 Grab et al.
6,562,462 B2 5/2003 Griffin et al.
6,576,182 B1 6/2003 Ravagni et al.
6,582,126 B2 6/2003 North
6,585,064 B2 7/2003 Griffin et al.
6,585,864 B1 7/2003 Fisher et al.
6,589,640 B2 7/2003 Griffin et al.
6,599,467 B1 7/2003 Yamaguchi et al.
6,607,693 B1 8/2003 Saito et al.
6,607,835 B2 8/2003 Fang et al.
6,620,375 B1 9/2003 Tank et al.
6,637,528 B2 10/2003 Nishiyama et al.
6,638,609 B2 10/2003 Nordgren et al.
6,648,068 B2 11/2003 Dewey et al.
6,649,682 B1 11/2003 Breton et al.
6,651,757 B2 11/2003 Belnap et al.
6,655,481 B2 12/2003 Findley et al.
6,655,882 B2 12/2003 Heinrich et al.
6,676,863 B2 1/2004 Christiaens et al.
6,682,780 B2 1/2004 Tzatzov et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,723,389 B2 4/2004 Kobayashi et al.
6,725,953 B2 4/2004 Truax et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,767,505 B2 7/2004 Witherspoon et al.
6,772,849 B2 8/2004 Oldham et al.
6,782,958 B2 8/2004 Liang et al.
6,799,648 B2 10/2004 Brandenberg et al.
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,884,496 B2 4/2005 Westphal et al.
6,884,497 B2 4/2005 Sulin et al.
6,892,793 B2 5/2005 Liu et al.
6,899,495 B2 5/2005 Hansson et al.
6,918,942 B2 7/2005 Hatta et al.
6,932,172 B2 8/2005 Dvorachek
6,933,049 B2 8/2005 Wan et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,017,677 B2 3/2006 Keshavan et al.
7,036,611 B2 5/2006 Radford et al.
7,044,243 B2 5/2006 Kembaiyan et al.
7,048,081 B2 5/2006 Smith et al.
7,070,666 B2 7/2006 Druschitz et al.
7,080,998 B2 7/2006 Hall et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,152,701 B2 12/2006 Butland et al.
7,172,142 B2 2/2007 Taylor et al.
7,175,404 B2 2/2007 Kondo et al.
7,192,660 B2 3/2007 Ruppi
7,204,117 B2 4/2007 Friedrichs
7,207,401 B2 4/2007 Dewey et al.
7,207,750 B2 4/2007 Annanolli et al.
7,216,727 B2 5/2007 Wardley
7,231,984 B2 6/2007 Jaensch
7,234,541 B2 6/2007 Scott et al.
7,234,550 B2 6/2007 Azar et al.
7,235,211 B2 6/2007 Griffo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,262,240 B1 8/2007 Breton et al.
7,267,187 B2 9/2007 Kembaiyan
7,267,543 B2 9/2007 Freidhoff et al.
7,270,679 B2 9/2007 Istephanous et al.
7,296,497 B2 11/2007 Kugelberg et al.
7,350,599 B2 4/2008 Lockwood et al.
7,381,283 B2 6/2008 Lee et al.
7,384,413 B2 6/2008 Gross et al.
7,384,443 B2 6/2008 Mirchandani et al.
7,395,882 B2 7/2008 Oldham et al.
7,410,610 B2 8/2008 Woodfield et al.
7,449,043 B2 * 11/2008 Collin et al. ..... 75/240
7,487,849 B2 2/2009 Radtke
7,494,507 B2 2/2009 Dixon
7,497,280 B2 3/2009 Brackin et al.
7,497,396 B2 3/2009 Splinter et al.
7,513,320 B2 4/2009 Mirchandani et al.
7,524,351 B2 4/2009 Hua et al.
7,556,668 B2 7/2009 Eason et al.
7,575,620 B2 8/2009 Terry et al.
7,625,157 B2 12/2009 Prichard et al.
7,632,323 B2 12/2009 Ganguly et al.
7,661,491 B2 2/2010 Kembaiyan et al.
7,687,156 B2 3/2010 Fang
7,699,904 B2 4/2010 Fang
7,703,555 B2 4/2010 Overstreet

(56) References Cited

U.S. PATENT DOCUMENTS

| | | | | |
|---|---|---|---|---|
| 7,810,588 | B2 | 10/2010 | McClain et al. | |
| 7,832,456 | B2 | 11/2010 | Calnan et al. | |
| 7,832,457 | B2 | 11/2010 | Calnan et al. | |
| 7,846,551 | B2 | 12/2010 | Fang et al. | |
| 7,887,747 | B2 | 2/2011 | Iwasaki et al. | |
| 7,954,569 | B2 | 6/2011 | Mirchandani et al. | |
| 8,007,714 | B2 | 8/2011 | Mirchandani et al. | |
| 8,007,922 | B2 | 8/2011 | Mirchandani et al. | |
| 8,025,112 | B2 | 9/2011 | Mirchandani et al. | |
| 8,087,324 | B2 | 1/2012 | Mirchandani et al. | |
| 8,109,177 | B2 | 2/2012 | Kembaiyan et al. | |
| 8,137,816 | B2 | 3/2012 | Fang et al. | |
| 8,141,665 | B2 | 3/2012 | Ganz | |
| 8,221,517 | B2 * | 7/2012 | Mirchandani et al. | 75/246 |
| 8,225,886 | B2 | 7/2012 | Mirchandani et al. | |
| 2002/0004105 | A1 | 1/2002 | Kunze et al. | |
| 2003/0010409 | A1 | 1/2003 | Kunze et al. | |
| 2003/0041922 | A1 | 3/2003 | Hirose et al. | |
| 2003/0051924 | A1 | 3/2003 | Tsuda et al. | |
| 2003/0219605 | A1 | 11/2003 | Molian et al. | |
| 2004/0013558 | A1 | 1/2004 | Kondoh et al. | |
| 2004/0105730 | A1 | 6/2004 | Nakajima | |
| 2004/0228695 | A1 | 11/2004 | Clauson | |
| 2004/0234820 | A1 | 11/2004 | Majagi | |
| 2004/0244540 | A1 | 12/2004 | Oldham et al. | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0019114 | A1 | 1/2005 | Sung | |
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0194073 | A1 | 9/2005 | Hamano et al. | |
| 2005/0211475 | A1 | 9/2005 | Mirchandani et al. | |
| 2005/0268746 | A1 | 12/2005 | Abkowitz et al. | |
| 2005/0276717 | A1 | 12/2005 | Fang | |
| 2006/0016521 | A1 | 1/2006 | Hanusiak et al. | |
| 2006/0024140 | A1 | 2/2006 | Wolff et al. | |
| 2006/0032677 | A1 | 2/2006 | Azar et al. | |
| 2006/0043648 | A1 | 3/2006 | Takeuchi et al. | |
| 2006/0060392 | A1 | 3/2006 | Eyre | |
| 2006/0118316 | A1 * | 6/2006 | Clark et al. | 173/128 |
| 2006/0131081 | A1 | 6/2006 | Mirchandani et al. | |
| 2006/0185773 | A1 | 8/2006 | Chiovelli | |
| 2006/0286410 | A1 | 12/2006 | Ahlgren et al. | |
| 2006/0288820 | A1 | 12/2006 | Mirchandani et al. | |
| 2007/0042217 | A1 * | 2/2007 | Fang et al. | 428/655 |
| 2007/0082229 | A1 | 4/2007 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0108650 | A1 | 5/2007 | Mirchandani et al. | |
| 2007/0126334 | A1 | 6/2007 | Nakamura et al. | |
| 2007/0163679 | A1 | 7/2007 | Fujisawa et al. | |
| 2007/0193782 | A1 | 8/2007 | Fang et al. | |
| 2007/0251732 | A1 | 11/2007 | Mirchandani et al. | |
| 2008/0011519 | A1 | 1/2008 | Smith et al. | |
| 2008/0101977 | A1 | 5/2008 | Eason et al. | |
| 2008/0196318 | A1 | 8/2008 | Bost et al. | |
| 2008/0302576 | A1 | 12/2008 | Mirchandani et al. | |
| 2009/0032501 | A1 | 2/2009 | Swingley et al. | |
| 2009/0041612 | A1 | 2/2009 | Fang et al. | |
| 2009/0136308 | A1 | 5/2009 | Newitt | |
| 2009/0180915 | A1 | 7/2009 | Mirchandani et al. | |
| 2009/0293672 | A1 | 12/2009 | Mirchandani et al. | |
| 2009/0301788 | A1 | 12/2009 | Stevens et al. | |
| 2010/0044114 | A1 | 2/2010 | Mirchandani et al. | |
| 2010/0044115 | A1 | 2/2010 | Mirchandani et al. | |
| 2010/0270086 | A1 | 10/2010 | Matthews et al. | |
| 2010/0278603 | A1 | 11/2010 | Fang et al. | |
| 2010/0290849 | A1 | 11/2010 | Mirchandani et al. | |
| 2010/0323213 | A1 | 12/2010 | Aitchison et al. | |
| 2011/0011965 | A1 | 1/2011 | Mirchandani et al. | |
| 2011/0107811 | A1 | 5/2011 | Mirchandani et al. | |
| 2011/0265623 | A1 | 11/2011 | Mirchandani et al. | |
| 2011/0284179 | A1 | 11/2011 | Stevens et al. | |
| 2011/0287238 | A1 | 11/2011 | Stevens et al. | |
| 2011/0287924 | A1 | 11/2011 | Stevens | |
| 2013/0025127 | A1 | 1/2013 | Mirchandani et al. | |
| 2013/0025813 | A1 | 1/2013 | Mirchandani et al. | |
| 2013/0026274 | A1 | 1/2013 | Mirchandani et al. | |
| 2013/0028672 | A1 | 1/2013 | Mirchandani et al. | |
| 2013/0036872 | A1 * | 2/2013 | Mirchandani et al. | 76/108.4 |
| 2013/0037985 | A1 | 2/2013 | Mirchandani | |
| 2013/0043615 | A1 | 2/2013 | Mirchandani et al. | |
| 2013/0048701 | A1 | 2/2013 | Mirchandani et al. | |
| 2013/0075165 | A1 | 3/2013 | Coleman et al. | |

FOREIGN PATENT DOCUMENTS

| | | | |
|---|---|---|---|
| CA | 1158073 | A | 12/1983 |
| CA | 1250156 | A | 2/1989 |
| CA | 2022065 | A1 | 2/1991 |
| CA | 2120332 | | 6/1993 |
| CA | 2107004 | C | 5/1996 |
| CA | 2228398 | A1 | 2/1997 |
| CA | 2198985 | A1 | 9/1998 |
| CA | 2108274 | C | 7/2000 |
| CA | 2212197 | C | 10/2000 |
| CA | 2201969 | C | 2/2003 |
| CA | 2213169 | C | 3/2005 |
| CA | 2498073 | A1 | 8/2006 |
| CA | 2556132 | A1 | 2/2007 |
| CA | 2570937 | A1 | 6/2007 |
| CA | 2357407 | C | 1/2008 |
| DE | 3830590 | A1 | 9/1989 |
| DE | 4200420 | A1 | 7/1993 |
| DE | 19634314 | | 1/1998 |
| DE | 10300283 | B3 | 6/2004 |
| DE | 102006030661 | A1 | 1/2008 |
| DE | 102007006943 | A1 | 8/2008 |
| EP | 0157625 | A2 | 10/1985 |
| EP | 0264674 | A2 | 4/1988 |
| EP | 0453428 | A1 | 10/1991 |
| EP | 0605585 | B1 | 8/1995 |
| EP | 0773202 | A2 | 5/1997 |
| EP | 0774527 | A2 | 5/1997 |
| EP | 0641620 | B1 | 2/1998 |
| EP | 0995876 | A2 | 4/2000 |
| EP | 1065021 | A1 | 1/2001 |
| EP | 1066901 | A2 | 1/2001 |
| EP | 1106706 | A1 | 6/2001 |
| EP | 0759480 | B1 | 1/2002 |
| EP | 1077268 | B1 | 5/2003 |
| EP | 1319483 | A2 | 6/2003 |
| EP | 1244531 | B1 | 10/2004 |
| EP | 1686193 | A2 | 8/2006 |
| EP | 1788104 | A1 | 5/2007 |
| EP | 2006047 | A2 | 12/2008 |
| EP | 2165790 | A1 | 3/2010 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2064619 | A | 6/1981 |
| GB | 2158744 | A | 11/1985 |
| GB | 2218931 | A | 11/1989 |
| GB | 2315452 | A | 2/1998 |
| GB | 2324752 | A | 11/1998 |
| GB | 2352727 | A | 2/2001 |
| GB | 2384745 | A | 8/2003 |
| GB | 2385350 | A | 8/2003 |
| GB | 2393449 | A | 3/2004 |
| GB | 2397832 | A | 8/2004 |
| GB | 2409467 | A | 6/2005 |
| GB | 2435476 | A | 8/2007 |
| JP | 51-114307 | | 10/1976 |
| JP | 51-124876 | A | 10/1976 |
| JP | 56-52604 | U | 5/1981 |
| JP | 59-54510 | A | 3/1984 |

(56) References Cited

FOREIGN PATENT DOCUMENTS

| | | | |
|---|---|---|---|
| JP | 59-56501 | A | 4/1984 |
| JP | 59-67333 | A | 4/1984 |
| JP | 59-169707 | A | 9/1984 |
| JP | 59-175912 | A | 9/1984 |
| JP | 60-48207 | A | 3/1985 |
| JP | 60-172403 | A | 9/1985 |
| JP | 61-226231 | A | 10/1986 |
| JP | 61-243103 | A | 10/1986 |
| JP | 61057123 | B | 12/1986 |
| JP | 62-34710 | A | 2/1987 |
| JP | 62-063005 | A | 3/1987 |
| JP | 62-170405 | A | 7/1987 |
| JP | 62-218010 | A | 9/1987 |
| JP | 62-278250 | A | 12/1987 |
| JP | 1-171725 | A | 7/1989 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 04-217414 | A | 8/1992 |
| JP | 5-50314 | A | 3/1993 |
| JP | 5-92329 | A | 4/1993 |
| JP | H05-64288 | | 8/1993 |
| JP | H03-119090 | U | 6/1995 |
| JP | 7-276105 | A | 10/1995 |
| JP | 60-224790 | A | 11/1995 |
| JP | 8-100589 | A | 4/1996 |
| JP | 8-120308 | A | 5/1996 |
| JP | H8-209284 | | 8/1996 |
| JP | 8-294805 | A | 11/1996 |
| JP | 9-11005 | A | 1/1997 |
| JP | 9-192930 | A | 7/1997 |
| JP | 9-253779 | A | 9/1997 |
| JP | 9-300024 | A | 11/1997 |
| JP | 10-138033 | A | 5/1998 |
| JP | 10-156607 | A | 6/1998 |
| JP | 10219385 | A | 8/1998 |
| JP | H10-511740 | A | 11/1998 |
| JP | 11-10409 | A | 1/1999 |
| JP | 11-36005 | A | 2/1999 |
| JP | 11-100605 | A | 4/1999 |
| JP | 11-300516 | A | 11/1999 |
| JP | 2000-237910 | A | 9/2000 |
| JP | 2000-296403 | A | 10/2000 |
| JP | 2000-355725 | A | 12/2000 |
| JP | 2001-179517 | A | 7/2001 |
| JP | 2002-097885 | A | 4/2002 |
| JP | 2002-166326 | A | 6/2002 |
| JP | 2002-317596 | A | 10/2002 |
| JP | 2003-306739 | A | 10/2003 |
| JP | 2003-342610 | A | 12/2003 |
| JP | 2004-514065 | A | 5/2004 |
| JP | 2004-160591 | A | 6/2004 |
| JP | 2004-181604 | A | 7/2004 |
| JP | 2004-190034 | A | 7/2004 |
| JP | 2004-243380 | A | 9/2004 |
| JP | 2004-315904 | A | 11/2004 |
| JP | 2005-36281 | A | 2/2005 |
| JP | 2005-111581 | A | 4/2005 |
| JP | 2005-519448 | A | 6/2005 |
| JP | 2006-175456 | A | 7/2006 |
| JP | 2006-181628 | A | 7/2006 |
| JP | 2006-524173 | A | 10/2006 |
| JP | 2006-328477 | A | 12/2006 |
| JP | 2008-127616 | A | 6/2008 |
| KR | 20050055268 | | 6/2005 |
| RU | 2135328 | C1 | 8/1999 |
| RU | 2173241 | C2 | 2/2000 |
| RU | 2167262 | C2 | 5/2001 |
| UA | 6742 | | 12/1994 |
| UA | 63469 | C2 | 1/2006 |
| UA | 23749 | U | 6/2007 |
| WO | WO 92/05009 | A1 | 4/1992 |
| WO | WO 92/22390 | A1 | 12/1992 |
| WO | WO 96/20058 | A1 | 7/1996 |
| WO | WO 97/19201 | A1 | 5/1997 |
| WO | WO 97/34726 | A1 | 9/1997 |
| WO | WO 98/28455 | A1 | 7/1998 |
| WO | WO 99/13121 | A1 | 3/1999 |
| WO | WO 97/00734 | A1 | 7/1999 |
| WO | WO 99/36590 | A1 | 7/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/030667 | A2 | 4/2005 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/115703 | A1 | 9/2008 |
| WO | 2010056478 | A1 | 5/2010 |
| WO | WO 2011/008439 | A2 | 1/2011 |
| WO | WO 2011/000348 | | 2/2011 |

OTHER PUBLICATIONS

Dynalloy Industries, G.M.A.C.E, 2003, printed Jul. 8, 2009, 1 page.
Alloys International (Australasia) Pty. Ltd., "The Tungsten Carbide Vibratory Feeder System", (undated) 6 pages.
Dynalloy Industries, Hardhead Technology, Tungsten Carbide Pellets, 2003, printed Jul. 8, 2009, 1 page.
Industrial Renewal Services, Steel BOC (Basic Oxygen Furnace) & BOP (Basic Oxygen Process) Hoods, printed Nov. 8, 2007, 2 pages.
UWO Products, printed Nov. 8, 2007 from http://www.universalweld.com/products.htm, 2 pages.
Shi et al., "Study on shaping technology of nanocrystalline WC-Co composite powder", Rare Metal and Materials and Engineering, vol. 33, Suppl. 1, Jun. 2004, pp. 93-96. (English abstract).
Office Action mailed Feb. 27, 2013 in U.S. Appl. No. 13/550,690.
Haynes et al., Physical Constants of Inorganic Compounds, CRC Handbook of Chemistry and Physics, 93rd Edition, Internet Version 2013, downloaded May 15, 2013, 2 pages.
"Percentage by Weight to Percentage by Volume Conversion Calculator", Roseller Sunga, n.d., May 15, 2013, http://www.handymath.com/cgi-bin/dnstywtvol.cgi?sumit=Entry, 1 page.
Office Action mailed Feb. 5, 2013 in U.S. Appl. No. 13/652,503.
Office Action mailed Jul. 5, 2013 in U.S. Appl. No. 13/652,503.
Office Action mailed Apr. 5, 2013 in U.S. Appl. No. 13/632,177.
Restriction Requirement mailed Jan. 3, 2013 in U.S. Appl. No. 13/632,178.
Office Action mailed Mar. 6, 2013 in U.S. Appl. No. 13/632,178.
Office Action mailed Jun. 28, 2012 in U.S. Appl. No. 13/222,324.
Office Action mailed Jul. 11, 2012 in U.S. Appl. No. 13/222,324.
Office Action mailed Nov. 6, 2012 in U.S. Appl. No. 13/222,324.
Notice of Allowance mailed Jul. 1, 2013 in U.S. Appl. No. 11/167,811.
Office Action mailed Nov. 16, 2012 in U.S. Appl. No. 12/397,597.
Office Action mailed Jun. 20, 2013 in U.S. Appl. No. 12/397,597.
Decision on Appeal mailed Jun. 3, 2013 in U.S. Appl. No. 10/903,198.
Notification of Reopening of Prosecution Due to Consideration of an Information Dosclosure Statement Filed After Mailing of a Notice of Allowance mailed Oct. 10, 2012 in U.S. Appl. No. 13/182,474.
Office Action mailed May 16, 2013 in U.S. Appl. No. 13/182,474.
Notice of Allowance mailed Feb. 4, 2008 in U.S. Appl. No. 11/013,842.
Office Action mailed Oct. 4, 2012 in U.S. Appl. No. 13/491,638.

(56) References Cited

OTHER PUBLICATIONS

Notice of Allowance mailed Mar. 6, 2013 in U.S. Appl. No. 13/491,638.
Corrected Notice of Allowability mailed Oct. 18, 2012 in U.S. Appl. No. 11/585,408.
Office Action mailed Jan. 23, 2013 in U.S. Appl. No. 13/652,508.
Office Action mailed Jul. 25, 2013 in U.S. Appl. No. 13/652,508.
Office Action mailed May 22, 2013 in U.S. Appl. No. 13/487,323.
Office Action mailed Sep. 19, 2013 in U.S. Appl. No. 13/487,323.
Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 18, 2001, pp. 547-552.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook, vol. 16 Machining, "Cemented Carbides" (ASM International 1989), pp. 71-89.
Metals Handbook, vol. 16 Machining, "Tapping" (ASM International 1989), pp. 255-267.
Peterman, Walter, "Heat-Sink Compound Protects the Unprotected," Welding Design and Fabrication, Sep. 2003, pp. 20-22.
Shi et al., "Composite Ductility—The Role of Reinforcement and Matrix", TMS Meeting, Las Vegas, NV, Feb. 12-16, 1995, 10 pages.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide—Cobalt—Ruthenium Cutting Tools for Machining Steels" Proceedings Annual Microprogramming Workshop, vol. 14, 1981, pp. 281-292.
Underwood, *Quantitative Stereology,* pp. 23-108 (1970).
Vander Vort, "Introduction to Quantitative Metallography", Tech Notes, vol. 1, Issue 5, published by Buehler, Ltd. 1997, 6 pages.
J. Gurland, *Quantitative Microscopy,* R.T. DeHoff and F.N. Rhines, eds., McGraw-Hill Book Company, New York, 1968, pp. 279-290.
You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
ASM Materials Engineering Dictionary, J.R. Davis, Ed., ASM International, Fifth printing, Jan. 2006, p. 98.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D. as filed in U.S. Appl. No. 11/737,993 on Sep. 9, 2009.
Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1994, pp. 799, 800, 1933, and 2047.
ProKon Version 8.6, The Calculation Companion, Properties for W, Ti, Mo, Co, Ni and FE, Copyright 1997-1998, 6 pages.
TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
The Thermal Conductivity of Some Common Materials and Gases, The Engineering ToolBox, printed from http://www.engineeringtoolbox.com/thermal-conductivity-d_429.html on Dec. 15, 2011, 4 pages.
ASTM G65-04, Standard Test Method for Measuring Abrasion Using the Dry Sand, Nov. 1, 2004, printed from http://infostore.saiglobal.com.
Tool and Manufacturing Engineers Handbook, Fourth Edition, vol. 1, Machining, Society of Manufacturing Engineers, Chapter 12, vol. 1, 1983, pp. 12-110-12-114.
Beard, T. "The Ins and Outs of Thread Milling; Emphasis: Hole Making, Interview", Modern Machine Shop, Gardner Publications, Inc. 1991, vol. 64, No. 1, 5 pages.
Koelsch, J., "Thread Milling Takes on Tapping", Manufacturing Engineering, 1995, vol. 115, No. 4, 6 pages.
Johnson, M. "Tapping, Traditional Machining Processes", 1997, pp. 255-265.
"Thread Milling", Traditional Machining Processes, 1997, pp. 268-269.
Scientific Cutting Tools, "The Cutting Edge", 1998, printed on Feb. 1, 2000, 15 pages.
Helical Carbide Thread Mills, Schmarje Tool Company, 1998, 2 pages.
Pyrotek, Zyp Zircwash, www.pyrotek.info, Feb. 2003, 1 page.
Sims et al., "Casting Engineering", Superalloys II, Aug. 1987, pp. 420-426.
Sikkenga, "Cobalt and Cobalt Alloy Castings", Casting, vol. 15, ASM Handbook, ASM International, 2008, pp. 1114-1118.
Starck, H.C., Surface Technology, Powders for PTA-Welding, Lasercladding and other Wear Protective Welding Applications, Jan. 2011, 4 pages.
U.S. Appl. No. 13/487,323, filed Jun. 4, 2012, (32 pages).
U.S. Appl. No. 13/491,638, filed Jun. 8, 2012, (54 pages).
U.S. Appl. No. 13/491,649, filed Jun. 8, 2012, (55 pages).
U.S. Appl. No. 13/591,282, filed Aug. 22, 2012, 2012, (54 pages).
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Notice of Allowance mailed May 9, 2012 in U.S. Appl. No. 11/585,408.
Notice of Allowance mailed Jul. 20, 2012 in U.S. Appl. No. 11/585,408.
Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Office Action mailed Jul. 22, 2011 in U.S. Appl. No. 11/167,811.
Office Action mailed Mar. 28, 2012 in U.S. Appl. No. 11/167,811.

(56) References Cited

OTHER PUBLICATIONS

Office Action mailed Mar. 19, 2009 in U.S. Appl. No. 11/737,993.
Office Action mailed Jun. 3, 2009 in U.S. Appl. No, 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Office Action mailed Jan. 6, 2012 in U.S. Appl. No. 11/737,993.
Advisory Action Before the Filing of an Appeal Brief mailed Mar. 22, 2012 in U.S. Appl. No. 11/737,993.
Notice of Allowance mailed Jul. 25, 2012 in U.S. Appl. No. 11/737,993.
Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed Nov. 17, 2011 in U.S. Appl. No. 12/397,597.
Advisory Action mailed Jan. 26, 2012 in U.S. Appl. No. 12/397,597.
Office Action mailed Apr. 13, 2012 in U.S. Appl. No. 12/397,597.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Office Action mailed Jan. 16, 2008 in U.S. Appl. No. 10/903,198.
Office Action mailed Oct. 31, 2008 in U.S. Appl. No. 10/903,198.
Office Action mailed Apr. 17, 2009 in U.S. Appl. No. 10/903,198.
Advisory Action before mailing of Appeal Brief mailed Jun. 29, 2009 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Office Action mailed Oct. 19, 2011 in U.S. Appl. No. 12/196,951.
Office Action mailed Mar. 19, 2012 in U.S. Appl. No. 12/196,951.
Notice of Allowance mailed Jul. 31, 2012 in U.S. Appl. No. 12/196,951.
Office Action mailed Oct. 13, 2011 in U.S. Appl. No. 12/179,999.
Notice of Allowance mailed Apr. 30, 2012 in U.S. Appl. No. 12/179,999.
Office Action mailed Aug. 29, 2011 in U.S. Appl. No. 12/476,738.
Office Action mailed Dec. 21, 2011 in U.S. Appl. No. 12/476,738.
Notice of Allowance mailed Apr. 17, 2012 in U.S. Appl. No. 12/476,738.
Corrected Notice of Allowability mailed Jun. 21, 2012 in U.S. Appl. No. 12/476,738.
Office Action mailed Nov. 14, 2011 in U.S. Appl. No. 12/502,277.
Office Action mailed Jan. 20, 2012 in U.S. Appl. No. 12/502,277.
Notice of Allowance mailed Jul. 10, 2012 in U.S. Appl. No. 12/502,277.
Supplemental Notice of Allowability mailed Jul. 20, 2012 in U.S. Appl. No. 12/502,277.
Office Action mailed Mar. 15, 2012 in U.S. Appl. No. 12/464,607.
Notice of Allowance mailed Apr. 9, 2012 in U.S. Appl. No. 12/464,607.
Notice of Allowance mailed Jul. 16, 2012 in U.S. Appl. No. 12/464,607.
Office Action mailed Oct. 31, 2011 in U.S. Appl. No. 13/207,478.
Office Action mailed Mar. 2, 2012 in U.S. Appl. No. 13/207,478.
Notice of Allowance mailed Apr. 13, 2012 in U.S. Appl. No. 13/207,478.
Supplemental Notice of Allowability mailed Jun. 29, 2012 in U.S. Appl. No. 13/207,478.
Office Action mailed Dec. 5, 2011 in U.S Appl. No. 13/182,474.
Office Action mailed Apr. 27, 2012 in U.S. Appl. No. 13/182,474.
Notice of Allowance mailed Jul. 18, 2012 in U.S. Appl. No. 13/182,474.
Office Action mailed Jun. 1, 2001 in U.S. Appl. No. 09/460,540.
Office Action mailed Dec. 1, 2001 in U.S. Appl. No. 09/460,540.
Office Action mailed Mar. 15, 2002 in U.S. Appl. No. 09/460,540.
Office Action mailed Jun. 18, 2002 in U.S. Appl. No. 09/460,540.
Notice of Allowance mailed Oct. 21, 2002 in U.S. Appl. No. 09/460,540.
Office Action mailed Jan. 16, 2007 in U.S. Appl. No. 11/013,842.
Office Action mailed Jul. 16, 2008 in U.S. Appl. No. 11/013,842.
Office Action mailed Jul. 30, 2007 in U.S. Appl. No. 11/013,842.
Notice of Allowance mailed Nov. 26, 2008 in U.S. Appl. No. 11/013,842.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3, 2007 for U.S. Appl. No. 10/922,750.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Aug. 31, 2007 in U.S. Appl. No. 11/206,368.
Office Action mailed Feb. 28, 2008 in U.S. Appl. No. 11/206,368.
Pre-Appeal Conference Decision mailed Jun. 19, 2008 in U.S. Appl. No. 11/206,368.
Notice of Allowance mailed Nov. 13, 2008 in U.S. Appl. No. 11/206,368.
Office Action mailed Apr. 30, 2009 in U.S. Appl. No. 11/206,368.
Notice of Allowance mailed Nov. 30, 2009 in U.S. Appl. No. 11/206,368.
Office Action mailed Sep. 2, 2011 in U.S. Appl. No. 12/850,003.
Notice of Allowance mailed Nov. 15, 2011 in U.S. Appl. No. 12/850,003.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
International Search Report for International Application No. PCT/US2013/049009 mailed on Jan. 20, 2014; 8 pgs.
European Search Report for EP Application No. 13172168 dated Jul. 22, 2013; 1 pg.
US 4,966,627, 10/1990, Keshavan et al. (withdrawn)

* cited by examiner

COMPOSITE SINTERED POWDER METAL ARTICLES

CROSS-REFERENCE TO RELATED APPLICATIONS

This application claims priority under 35 U.S.C. §120 as a continuation-in-part of U.S. patent application Ser. No. 13/487,323, filed Jun. 4, 2012, entitled "Cemented Carbide-Metallic Alloy Composites"; which claims priority to U.S. patent application Ser. No. 12/476,738, filed Jun. 2, 2009, now issued as U.S. Pat. No. 8,221,517; which claims priority to U.S. Provisional Patent Application Ser. No. 61/057,885, filed Jun. 2, 2008, now abandoned.

FIELD OF TECHNOLOGY

The present disclosure relates to improved articles including cemented hard particles and methods of making such articles.

BACKGROUND

Materials composed of cemented hard particles are technologically and commercially important. Cemented hard particles include a discontinuous dispersed phase of hard metal-containing and/or ceramic particles embedded in a continuous metallic binder phase. Many such materials possess unique combinations of abrasion and wear resistance, strength, and fracture toughness. Cemented carbides find extensive use in applications requiring high wear resistance such as, for example, metalcutting and metalforming tools, earth boring and rock cutting tools, wear parts in machinery, and the like.

Terms used herein have the following meanings. "Strength" is the stress at which a material ruptures or fails. "Fracture toughness" is the ability of a material to absorb energy and deform plastically before fracturing. "Toughness" is proportional to the area under the stress-strain curve from the origin to the breaking point. See McGraw Hill Dictionary of Scientific and Technical Terms (5th ed. 1994). "Wear resistance" is the ability of a material to withstand damage to its surface. "Wear" generally involves progressive loss of material due to a relative motion between a material and a contacting surface or substance. See Metals Handbook Desk Edition (2d ed. 1998).

The dispersed hard particle phase typically includes grains of, for example, one or more of a carbide, a nitride, a boride, a silicide, an oxide, and solid solutions of any of these types of compounds. Hard particles commonly used in cemented hard particle materials are metal carbides such as tungsten carbide and, thus, these materials are often referred to generically as "cemented carbides." The continuous binder phase, which binds or "cements" the hard particles together, generally includes, for example, at least one of cobalt, cobalt alloy, nickel, nickel alloy, iron, and iron alloy. Additionally, alloying elements such as, for example, chromium, molybdenum, ruthenium, boron, tungsten, tantalum, titanium, and niobium can be included in the binder phase to enhance particular properties. The various commercially available cemented carbide grades differ in terms of at least one property such as, for example, composition, grain size, or volume fractions of the discontinuous and/or continuous phases.

In most applications cemented carbide components are used as part of a larger assembly of parts that make up the final product employed for metalcutting, metalforming, rock drilling, and the like. For example, tools for metalcutting typically comprise a steel tool holder onto which cemented carbide inserts are attached. Similarly, tools for metalforming typically comprise a cemented carbide sleeve or insert attached to a steel body. Also, rotary cone drills employed for earth boring comprise an assembly of steel parts and cemented carbide earth boring inserts. Further, diamond-based earth boring bits comprise a cemented carbide body attached to a threaded steel sleeve.

For certain applications, parts formed from cemented hard particles can be attached to parts formed of different materials such as, for example, steels, nonferrous metal alloys, and plastics. Techniques that have been used to attach such parts include metallurgical techniques such as, for example, brazing, welding, and soldering, and mechanical techniques such as, for example, press or shrink fitting, application of epoxy and other adhesives, and mating of mechanical features such as threaded coupling and keyway arrangements.

Problems are encountered when attaching cemented hard particle parts to parts formed of steels or nonferrous alloys using conventional metallurgical or mechanical techniques. The difference in coefficient of thermal expansion (CTE) between cemented carbide materials and most steels (as well as most nonferrous alloys) is significant. For example, the CTE of steel ranges from about $10\times10^{-6}$ in/in/K to $15\times10^{-6}$ in/in/K, which is about twice the range of about $5\times10^{-6}$ in/in/K to $7\times10^{-6}$ in/in/K CTE for a cemented carbide. The CTE of certain nonferrous alloys exceeds that of steel, resulting in an even more significant CTE mismatch. If metallurgical bonding techniques such as brazing or welding are employed to attach a cemented carbide part to a steel part, for example, enormous stresses can develop at the interface between the parts during cooling due to differences in rates of part contraction. These stresses often result in the development of cracks at and near the interface of the parts. These defects weaken the bond between the cemented hard particle region and the metal or metallic region, and also the attached regions of the parts themselves.

In general, it is usually not practical to mechanically attach cemented hard particle parts to steel or other metallic parts using threads, keyways, or other mechanical features because the fracture toughness of cemented carbides is low relative to steel and other metals and metal alloys. Moreover, cemented carbides, for example, are highly notch-sensitive and susceptible to premature crack formation at sharp corners. Corners are difficult to avoid including in parts when designing mechanical features such as threads and keyways on the parts. Thus, the cemented hard particle parts can prematurely fracture in the areas incorporating the mechanical features.

The technique described in U.S. Pat. No. 5,359,772 to Carlsson et al. attempts to overcome certain difficulties encountered in forming composite articles having a cemented carbide region attached to a metal region. Carlsson teaches a technique of spin-casting iron onto pre-formed cemented carbide rings. Carlsson asserts that the technique forms a "metallurgical bond" between the iron and the cemented carbide. The composition of the cast iron in Carlsson must be carefully controlled such that a portion of the austenite forms bainite in order to relieve the stresses caused by differential shrinkage between the cemented carbide and the cast iron during cooling from the casting temperature. However, this transition occurs during a heat treating step after the composite is formed, to relieve stress that already exists. Thus, the bond formed between the cast iron and the cemented carbide in the method of Carlsson can already suffer from stress damage. Further, a bonding technique as described in Carlsson has limited utility and will only potentially be effective when using spin casting and cast iron, and would not be effective with other metals or metal alloys.

The difficulties associated with the attachment of cemented hard particle parts to parts of dissimilar materials, and particularly metallic parts, have posed substantial challenges to design engineers and have limited the applications for cemented hard particle parts. As such, there is a need for improved cemented hard particle-metallic articles and related materials, methods, and designs.

SUMMARY

One non-limiting embodiment according to the present disclosure is directed to a composite sintered powder metal article that includes: a first region including a cemented hard particle material; and a second region. The second region includes: a metallic material that is one of a metal and a metal alloy selected from a steel, nickel, a nickel alloy, titanium, a titanium alloy, molybdenum, a molybdenum alloy, cobalt, a cobalt alloy, tungsten, a tungsten alloy; and from 0 up to 30 percent by volume of hard particles dispersed in the metallic material. The first region is metallurgically bonded to the second region, and each of the first region and the second region has a thickness greater than 100 microns. The second region comprises at least one mechanical attachment feature adapted to attach the composite sintered powder metal article to another article using the at least one mechanical attachment feature. In non-limiting embodiments, the at least one mechanical attachment feature comprises at least one of a thread, a slot, a keyway, a clamping region, a tooth, a cog, a step, a bevel, a bore, a pin, and an arm. In non-limiting embodiments, the composite sintered powder metal article comprises a fixed cutter earth boring bit, a earth boring insert for a rotary cone earth boring bit, a metal cutting drill bit, a modular metal cutting drill bit, a mill roll, and a burnishing roll.

According to another aspect of the present disclosure, in a non-limiting embodiment, a composite sintered powder metal article is an earth boring article. The composite sintered powder metal earth boring article comprises: a first region that is a working region comprising a cemented hard particle material; and a second region that is a metallic region. The metallic region comprises: a metallic material that is one of a metal and a metal alloy selected from a steel, nickel, a nickel alloy, titanium, a titanium alloy, molybdenum, a molybdenum alloy, cobalt, a cobalt alloy, tungsten, and a tungsten alloy; and from 0 up to 30 percent by volume of hard particles dispersed in the metallic material. The working region is metallurgically bonded to the metallic region, and each of the working region and the metallic region has a thickness greater than 100 microns. The metallic region comprises at least one mechanical attachment feature adapted to attach the composite sintered powder metal earth boring article to another article using the at least one mechanical attachment feature. In non-limiting embodiments, the at least one mechanical feature comprises at least one of a thread, a slot, a keyway, a clamping region, a tooth, a cog, a step, a bevel, a bore, a pin, and an arm. In non-limiting embodiments, the earth boring article comprises one of a fixed cutter earth boring bit, an earth boring insert for a rotary cone earth boring bit, a nozzle for a rotary cone earth boring bit, a nozzle for an earth boring percussion bit, a gage brick, a polycrystalline diamond compact (PDC) substrates, and a coal pick.

According to still another aspect of the present disclosure, in a non-limiting embodiment, a composite sintered powder metal article is a metalcutting tool. The composite sintered powder metal metalcutting tool comprises: a first region that is a working region comprising a cemented hard particle material, and a second region that is a metallic region. The metallic region comprises: a metallic material that is that is one of a metal and a metal alloy selected from a steel, nickel, a nickel alloy, titanium, a titanium alloy, molybdenum, a molybdenum alloy, cobalt, a cobalt alloy, tungsten, and a tungsten alloy; and from 0 up to 30 percent by volume of hard particles dispersed in the metallic material. The working region is metallurgically bonded to the metallic region, and each of the working region and the metallic region has a thickness greater than 100 microns. The metallic region comprises at least one mechanical attachment feature adapted to attach the composite sintered powder metal metalcutting tool to another article using the at least one mechanical attachment feature. In non-limiting embodiments, the at least one mechanical feature comprises at least one of a thread, a slot, a keyway, a clamping region, a tooth, a cog, a step, a bevel, a bore, a pin, and an arm. In non-limiting embodiments, the composite sintered powder metal metalcutting tool comprises one of a metalcutting drill bit, a modular metalcutting drill bit, a milling tool, a modular milling tool, a turning tool, a shaping tool, a threading tool, a drilling tool, a hobbing and gear cutting tool, a tapping tool, a sawing tool, and a reaming tool.

According to yet another aspect of the present disclosure, in a non-limiting embodiment, a composite sintered powder metal article is a metalforming tool. The composite sintered powder metal metalforming tool comprises: a first region that is a working region comprising a cemented hard particle material; and a second region that is a metallic region. The metallic region comprises: a metallic material that is one of a metal and a metal alloy selected from a steel, nickel, a nickel alloy, titanium, a titanium alloy, molybdenum, a molybdenum alloy, cobalt, a cobalt alloy, tungsten, and a tungsten alloy; and from 0 up to 30 percent by volume of hard particles dispersed in the metallic material. The working region is metallurgically bonded to the metallic region, and each of the working region and the metallic region has a thickness greater than 100 microns. The metallic region comprises at least one mechanical attachment feature adapted to attach the composite sintered powder metal metalforming tool to another article using the at least one mechanical attachment feature. In non-limiting embodiments, the at least one mechanical feature comprises at least one of a thread, a slot, a keyway, a clamping region, a tooth, a cog, a step, a bevel, a bore, a pin, and an arm. In certain non-limiting embodiments, the composite sintered powder metal metalforming tool comprises one of a mill roll, a burnishing roll, a wire-drawing die, a tube drawing die, a bar drawing die, a heading die, a powder compacting die, a progression die, a lamination die, a punching die, an extrusion die, a hot forging die, a cold forging die, a peeling die, a trimming die, a nail-gripper die, a spring forming die, a wire forming die, a swaging die, a wire flattening die, a wire flattening roll, a mandrel, a tube drawing plug, a can forming die, a roll for hot rolling of metals, and a roll for cold rolling of metals.

According to yet another aspect of the present disclosure, in a non-limiting embodiment, a composite sintered powder metal article is a woodworking tool. The composite sintered powder metal woodworking tool comprises: a first region that is a working region comprising a cemented hard particle material; and a second region that is a metallic region; The metallic region comprises: a metallic material that is one of a metal and a metal alloy selected from a steel, nickel, a nickel alloy, titanium, a titanium alloy, molybdenum, a molybdenum alloy, cobalt, a cobalt alloy, tungsten, and a tungsten alloy; and from 0 up to 30 percent by volume of hard particles dispersed in the metallic material. The working region is metallurgically bonded to the second region, and each of the first region and the second region has a thickness greater than 100 microns. The metallic region comprises at least one mechanical attachment feature adapted to attach the composite sintered powder metal woodworking tool to another article using the at least one mechanical attachment feature. In non-limiting embodiments, the at least one mechanical feature comprises at least one of a thread, a slot, a keyway, a clamping region, a tooth, a cog, a step, a bevel, a bore, a pin, and an arm. In certain non-limiting embodiments, the composite sintered powder metal woodworking tool comprises one of a woodcutting saw blade, a plane iron, a router, and a saw.

According to yet another aspect of the present disclosure, in a non-limiting embodiment, a composite sintered powder metal article is a wear article. The composite sintered powder metal wear article comprises: a first region that is a wear region comprising a cemented hard particle material; and a second region that is a metallic region. The metallic region comprises: a metallic material that is one of a metal and a metal alloy selected from a steel, nickel, a nickel alloy, titanium, a titanium alloy, molybdenum, a molybdenum alloy, cobalt, a cobalt alloy, tungsten, and a tungsten alloy; and from 0 up to 30 percent by volume of hard particles dispersed in the metallic material. The wear region is metallurgically bonded to the metallic region, and each of the wear region and the metallic region has a thickness greater than 100 microns. The metallic region comprises at least one mechanical attachment feature adapted to attach the composite sintered powder metal wear article to another article using the at least one mechanical attachment feature. In non-limiting embodiments, the at least one mechanical feature comprises at least one of a thread, a slot, a keyway, a clamping region, a tooth, a cog, a step, a bevel, a bore, a pin, and an arm. In certain non-limiting embodiments, the composite sintered powder metal wear article comprises one of an anvil, a die for diamond synthesis, a shot blast nozzle, a paint nozzle, a boring bar, a slitting knife, a seal ring, a valve component, a plug gauge, a slip gauge, a ring gauge, a ball for an oil pump, a seat for an oil pump, a trim component for oilfield applications, and a choke component for oilfield applications.

BRIEF DESCRIPTION OF THE FIGURES

Features and advantages of the subject matter described herein can be better understood by reference to the accompanying figures in which.

DETAILED DESCRIPTION

Figure 1:
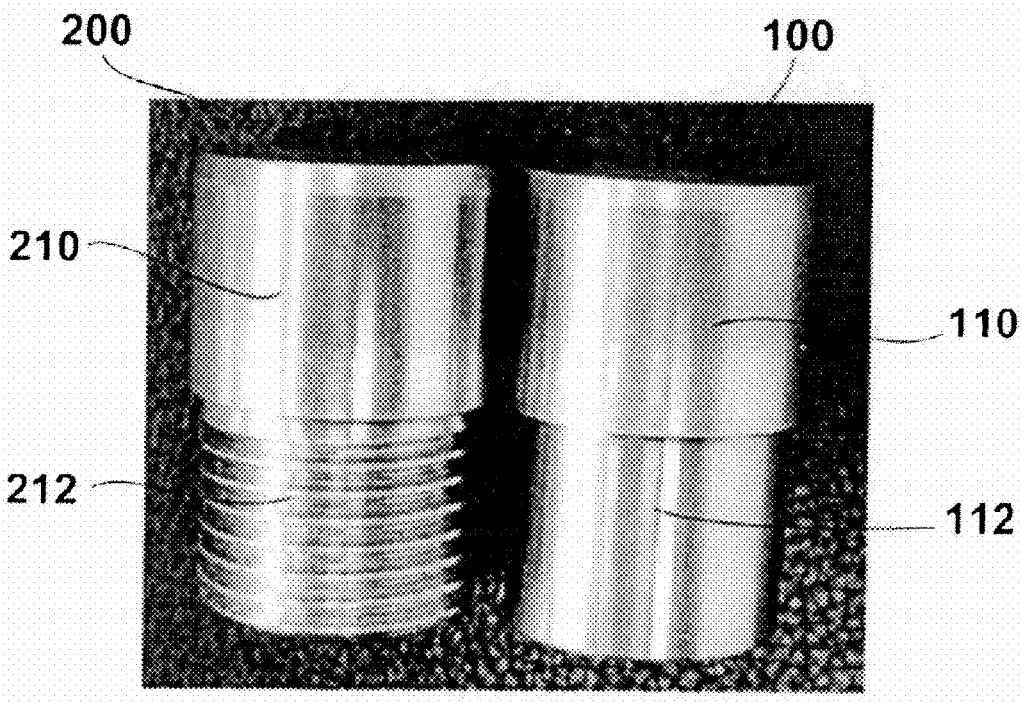
FIG. 1 illustrates non-limiting embodiments of composite sintered powder metal articles according to the present disclosure including a cemented carbide region metallurgically bonded to a nickel region, wherein the article depicted on the left includes threads machined into the nickel region.

In the present description of non-limiting embodiments and in the claims, other than in the operating examples or where otherwise indicated, all numbers expressing quantities or characteristics of ingredients and products, processing conditions, and the like are to be understood as being modified in all instances by the term "about". Accordingly, unless indicated to the contrary, any numerical parameters set forth in the following description and the attached claims are approximations that can vary depending upon the desired properties one seeks to obtain in the subject matter described in the present disclosure. At the very least, and not as an attempt to limit the application of the doctrine of equivalents to the scope of the claims, each numerical parameter should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Any patent, publication, or other disclosure material, in whole or in part, that is said to be incorporated by reference herein is incorporated herein only to the extent that the incorporated material does not conflict with existing definitions, statements, or other disclosure material set forth in the present disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Certain embodiments according to the present disclosure are directed to composite sintered powder metal articles. A composite article is an object that comprises at least two regions, each region composed of a different material. Composite sintered powder metal articles according to the present disclosure include at least a first region that can be a working region or wear region and includes a cemented hard particle material. The first region is metallurgically bonded to a second region that is a metallic region and includes a metallic material that is one of a metal and a metal alloy. Two non-limiting examples of composite articles according to the present disclosure are shown in FIG. 1. Composite sintered powder metal article 100 includes a first region in the form of a cemented carbide region 110 metallurgically bonded to a second region in the form of a nickel region 112. Composite sintered powder metal article 200 includes a first region in the form of a cemented carbide region 210 metallurgically bonded to a second region in the form of a threaded nickel region 212.

As is known in the art, sintered powder metal material is produced by pressing and sintering masses of metallurgical powders. In a conventional press-and-sinter process, a metallurgical powder blend is placed in a void of a mold and compressed to form a "green compact." The green compact is sintered, which densifies the compact and metallurgically bonds together the individual powder particles. In certain instances, the compact can be consolidated during sintering to full or near-full theoretical density.

In composite articles according to the present disclosure, the cemented hard particle material of the first region is a composite including a discontinuous phase of hard particles dispersed in a continuous binder phase. The metallic material included in the second region is at least one of a steel, nickel, a nickel alloy, titanium, a titanium alloy, molybdenum, a molybdenum alloy, cobalt, a cobalt alloy, tungsten, and a tungsten alloy. The two regions are formed from metallurgical powders that are pressed and sintered together. During sintering, a metallurgical bond forms between the first and second regions, for example, at the interface between the cemented hard particle material in the first region and the metallic material in the second region.

The present inventors determined that the metallurgical bond that forms between the first region (including a cemented hard particle material) and the second region (including a metallic material that is one of a metal and a metal alloy) during sintering is surprisingly and unexpectedly strong. In various embodiments produced according to the present disclosure, the metallurgical bond between the first and second regions is free from significant defects, including cracks and brittle secondary phases. Such bond defects commonly are present when conventional techniques are used to bond a cemented hard particle material to a metal or metal alloy. The metallurgical bond formed according to the present disclosure forms directly between the first and second regions at the microstructural level and is significantly stronger than bonds formed by prior art techniques used to bind together cemented carbides and metal or metal alloys, such as, for example, the casting technique discussed in U.S. Pat. No. 5,359,772 to Carlsson. The method of Carlsson involving casting a molten iron onto cemented hard particles does not form a strong bond. Molten iron reacts with cemented carbides by chemically reacting with the tungsten carbide particles and forming a brittle phase commonly referred to as eta-phase. The interface is thus weak and brittle. The bond formed by the technique described in Carlsson is limited to the relatively weak bond that can be formed between a relatively low-melting molten cast iron and a pre-formed cemented carbide. Further, this technique only applies to cast iron because it relies on an austenite to bainite transition to relieve stress at the bond area.

The metallurgical bond formed by the present press-and-sinter technique using the materials recited herein avoids the stresses and cracking experienced with other bonding techniques. The strong bond formed according to the present disclosure effectively counteracts stresses resulting from differences in thermal expansion properties of the bonded materials, such that no cracks form in the interface between the first and second regions of the composite articles. This is believed to be at least partially a result of the nature of the unexpectedly strong metallurgical bond formed by the technique of the present disclosure, and also is a result of the compatibility of the materials discovered in the present technique. It has been discovered that not all metals and metal alloys can be sintered to cemented hard particle material such as cemented carbide.

In certain non-limiting embodiments according to the present disclosure, the first region comprising cemented hard particle material has a thickness greater than 100 microns. Also, in certain non-limiting embodiments, the first region has a thickness greater than that of a coating. In certain non-limiting embodiments according to the present disclosure, the first and second regions each have a thickness greater than 100 microns. In certain other non-limiting embodiments, each of the first and second regions has a thickness greater than 0.1 centimeters. In still other embodiments, the first and second regions each have a thickness greater than 0.5 centimeters. Certain other non-limiting embodiments according to the present disclosure include first and second regions having a thickness greater than 1 centimeter. Still other embodiments comprise first and second regions having a thickness greater than 5 centimeters. Also, In certain non-limiting embodiments according to the present disclosure, at least the second region or another region of the composite sintered powder metal article has a thickness sufficient for the region to include mechanical attachment features such as, for example, threads or keyways, so that the composite article can be attached to another article via the mechanical attachment features.

The embodiments described herein achieve an unexpectedly and surprisingly strong metallurgical bond between the first region (including a cemented hard particle material) and the second region (including a metallic material that is one of a metal and a metal alloy) of the composite article. In certain non-limiting embodiments according to the present disclosure, the formation of the superior bond between the first and second regions is combined with incorporating advantageous mechanical features, such as threads or keyways, on the second region of the composite to provide a strong and durable composite article that can be used in a variety of applications or adapted for connection to other articles for use in specialized applications.

In other non-limiting embodiments according to the present disclosure, a metal or metal alloy of the second region has a thermal conductivity less than a thermal conductivity of the cemented hard particle material of the first region, wherein both thermal conductivities are evaluated at room temperature (20° C.). Without being limited to any specific theory, it is believed that the metal or metal alloy of the second region must have a thermal conductivity that is less than a thermal conductivity of the cemented hard particle material of the first region in order to form a metallurgical bond between the first and second regions having sufficient strength for certain demanding applications. In certain non-limiting embodiments, only metals or metal alloys having thermal conductivity less than a cemented carbide can be used in the second region. In certain non-limiting embodiments, the second region or any metal or metal alloy of the second region has a thermal conductivity less than 100 W/mK. In other non-limiting embodiments, the second region or any metal or metal alloy of the second region can have a thermal conductivity less than 90 W/mK.

In certain other non-limiting embodiments according to the present disclosure, the metal or metal alloy of the second region of the composite article has a melting point greater than 1200° C. Without being limited to any specific theory, it is believed that the metal or metal alloy of the second region must have a melting point greater than 1200° C. so as to form a metallurgical bond with the cemented hard particle material of the first region with bond strength sufficient for certain demanding applications. In other non-limiting embodiments, the metal or metal alloy of the second region of the composite article has a melting point greater than 1275° C. In some embodiments, the melting point of the metal or metal alloy of the second region is greater than a cast iron.

According to the present disclosure, the cemented hard particle material included in the first region must include at least 60 percent by volume dispersed hard particles. If the cemented hard particle material includes less than 60 percent by volume of hard particles, the cemented hard particle material will lack the required combination of abrasion and wear resistance, strength, and fracture toughness needed for applications in which cemented hard particle materials are used. See Kenneth J. A. Brookes, Handbook of Hardmetals and Hard Materials (International Carbide Data, 1992). Accordingly, as used herein, the phrases "cemented hard particles" and "cemented hard particle material" refer to a composite material comprising a discontinuous phase of hard particles dispersed in a continuous binder material, and wherein the composite material includes at least 60 volume percent of the hard particle discontinuous phase.

In certain non-limiting embodiments of the composite article according to the present disclosure, the metal or metal alloy of the second region can include from 0 up to 50 volume percent of hard particles (based on the volume of the metal or metal alloy) dispersed therein. The presence of certain concentrations of such particles in the metal or metal alloy can enhance wear resistance of the metal or alloy relative to the same material lacking such hard particles, but without significantly adversely affecting machinability of the metal or metal alloy. Obviously, the presence of up to 50 volume percent of such particles in the metallic material of the second region does not result in a cemented hard particle material, as defined herein, for at least the reason that the hard particle volume fraction is significantly less than in a cemented hard particle material. In addition, it has been discovered that in certain composite articles according to the present disclosure, the presence of hard particles in the metal or metal alloy of the second region can modify the shrinkage characteristics of the region so as to more closely approximate the shrinkage characteristics of the first region. In this way, the CTE of the second region can be adjusted to better ensure compatibility with the CTE of the first region to prevent formation of stresses in the metallurgical bond region that could result in cracking.

Thus, in certain non-limiting embodiments according to the present disclosure, the metal or metal alloy of the second region of the composite article includes from 0 up to 50 percent by volume, or 0 up to 30 percent by volume, and preferably no more than 20 to 30 percent by volume hard particles dispersed in the metal or metal alloy. The minimum amount of hard particles in the metal or metal alloy region that would affect the wear resistance and/or shrinkage properties of the metal or metal alloy is believed to be about 2 to 5 percent by volume. Thus, In certain non-limiting embodiments according to the present disclosure, the metal or metal alloy of the second region of the composite article includes from 2 to 50 percent by volume, and preferably from 2 to 30 percent by volume hard particles dispersed in the metal or metal alloy. Other embodiments can include from 5 to 50 percent by volume hard particles, or from 5 to 30 percent by volume hard particles dispersed in the metal or metal alloy. Still other embodiments can comprise from 2 to 20, or from 5 to 20 percent by volume hard particles dispersed in the metal or metal alloy. Certain other non-limiting embodiments can comprise from 20 to 30 percent by volume hard particles dispersed in the metal or metal alloy.

The term "hard particles", as used herein refers to particles or powders having a hardness of about 80 HRA or greater, or 700 HV or greater. The hard particles included in the first region and, optionally, the second region can be selected from, for example, the group consisting of carbide particles, nitride particles, boride particles, silicide particles, oxide particles, and mixtures and solid solutions thereof. In certain non-limiting embodiments, the metal or metal alloy of the second region includes up to 50 percent by volume, or up to 30 percent by volume of dispersed tungsten carbide particles.

In certain non-limiting embodiments according to the present disclosure, the dispersed hard particle phase of the cemented hard particle material of the first region can include one or more hard particles selected from carbide particles, nitride particles, boride particles, silicide particles, oxide particles, and particles including mixtures or solid solutions of one or more thereof. In certain non-limiting embodiments, the hard particles can include carbide particles of at least one transition metal selected from titanium, chromium, vanadium, zirconium, hafnium, tantalum, molybdenum, niobium, and tungsten. In still other non-limiting embodiments, the continuous binder phase of the cemented hard particle material of the first region includes at least one of cobalt, a cobalt alloy, nickel, a nickel alloy, iron, and an iron alloy. The binder also can include, for example, one or more elements selected from tungsten, chromium, titanium, tantalum, vanadium, molybdenum, niobium, zirconium, hafnium, and carbon, up to the solubility limits of these elements in the binder. Additionally, the binder can include up to 5 weight percent of one or more elements selected from copper, manganese, silver, aluminum, and ruthenium. One skilled in the art will recognize that any or all of the constituents of the cemented hard particle material can be introduced into the metallurgical powder from which the cemented hard particle material is formed in elemental form, as compounds, and/or as master alloys, for example.

The properties of cemented hard particle materials, such as cemented carbides, depend on parameters including the average hard particle grain size and the weight fraction or volume fraction of the hard particles and/or binder. In general, the hardness and wear resistance increases as the grain size decreases and/or the binder content decreases. On the other hand, fracture toughness increases as the grain size increases and/or the binder content increases. Thus, there is a trade-off between wear resistance and fracture toughness when selecting a cemented hard particle material grade for any application. As wear resistance increases, fracture toughness typically decreases, and vice versa.

Certain non-limiting embodiments of the articles of the present disclosure include hard particles comprising carbide particles of at least one transition metal selected from titanium, chromium, vanadium, zirconium, hafnium, tantalum, molybdenum, niobium, and tungsten. In certain non-limiting embodiments, the hard particles include tungsten carbide particles. In certain non-limiting embodiments, the tungsten carbide particles can have an average grain size of from 0.3 to 10 μm.

The hard particles of the cemented hard particle material in the first region preferably comprise from about 60 to about 98 volume percent of the total volume of the cemented hard particle material. The hard particles are dispersed within a matrix of a binder that preferably constitutes from about 2 to about 40 volume percent of the total volume of the cemented hard particle material.

Embodiments of the composite articles according to the present disclosure can also include hybrid cemented carbides such as, for example, any of the hybrid cemented carbides described in U.S. Pat. No. 7,384,443, the entire disclosure of which is hereby incorporated herein by reference. For example, an article according to the present disclosure can comprise at least a first region including a hybrid cemented carbide metallurgically bonded to a second region comprising one of a metal and a metal alloy. Certain other articles can comprise at least a first region including a cemented hard particle material, a second region including a metallic material that is at least one of a metal and a metal alloy, and a third region including a hybrid cemented carbide material, wherein the first and third regions are metallurgically bonded to the second region.

Generally, a hybrid cemented carbide is a material comprising particles of at least one cemented carbide grade dispersed throughout a second cemented carbide continuous phase, thereby forming a microscopic composite of cemented carbides. The hybrid cemented carbides of U.S. Pat. No. 7,384,443 have low dispersed phase particle contiguity ratios and improved properties relative to certain other hybrid cemented carbides. Preferably, the contiguity ratio of the dispersed phase of a hybrid cemented carbide included in embodiments according to the present disclosure is less than or equal to 0.48. Also, a hybrid cemented carbide included in the embodiments according to the present disclosure preferably comprises a dispersed phase having a hardness greater than a hardness of the continuous phase of the hybrid cemented carbide. For example, in certain non-limiting embodiments of hybrid cemented carbides included in one or more regions of the composite articles according to the present disclosure, the hardness of the dispersed phase in the hybrid cemented carbide is preferably greater than or equal to 88 Rockwell A Hardness (HRA) and less than or equal to 95 HRA, and the hardness of the continuous phase in the hybrid cemented carbide is greater than or equal to 78 HRA and less than or equal to 91 HRA.

Additional non-limiting embodiments of the articles according to the present disclosure can include hybrid cemented carbide in one or more regions of the articles wherein a volume fraction of the dispersed cemented carbide phase is less than 50 volume percent of the hybrid cemented carbide, and wherein the contiguity ratio of the dispersed cemented carbide phase is less than or equal to 1.5 times the volume fraction of the dispersed cemented carbide phase in the hybrid cemented carbide.

Embodiments of the method of producing hybrid cemented carbides allows forming such materials with a low contiguity ratio of the dispersed cemented carbide phase. The degree of dispersed phase contiguity in composite structures can be characterized as the contiguity ratio, $C_t$. $C_t$ can be determined using a quantitative metallography technique described in Underwood, Quantitative Microscope, 279-290 (1968), hereby incorporated by reference. The technique is further defined in U.S. Pat. No. 7,384,443 and consists of determining the number of intersections that randomly oriented lines of known length, placed on the microstructure as a photomicrograph of the material, make with specific structural features. The total number of intersections made by the lines with dispersed phase/dispersed phase intersections are counted ($N_{L\alpha\alpha}$), as are the number of intersections made by the lines with dispersed phase/continuous phase interfaces ($N_{L\alpha\beta}$). The contiguity ratio, $C_t$, is calculated by the equation $C_t=2\,N_{L\alpha\alpha}/(N_{L\alpha\beta}+2\,N_{L\alpha\alpha})$.

The contiguity ratio is a measure of the average fraction of the surface area of dispersed phase particles in contact with other dispersed first phase particles. The ratio can vary from 0 to 1 as the distribution of the dispersed particles varies from completely dispersed to a fully agglomerated structure. The contiguity ratio describes the degree of continuity of dispersed phase irrespective of the volume fraction or size of the dispersed phase regions. However, typically, for higher volume fractions of the dispersed phase, the contiguity ratio of the dispersed phase will also likely be higher.

In the case of hybrid cemented carbides having a hard cemented carbide dispersed phase, the lower the contiguity ratio the greater the chance that a crack will not propagate through contiguous hard phase regions. This cracking process can be a repetitive one with cumulative effects resulting in a reduction in the overall toughness of the hybrid cemented carbide article, e.g., an earth-drilling bit.

A method of producing hybrid cemented carbides with improved properties is disclosed in U.S. Pat. No. 7,384,443. The method of producing a hybrid cemented carbide includes blending at least one of partially and fully sintered granules of the dispersed cemented carbide grade with at least one of green and unsintered granules of the continuous cemented carbide grade. The blend is then consolidated, and is sintered using conventional means. Partial or full sintering of the granules of the dispersed phase results in strengthening of the granules (as compared to "green" granules). In turn, the strengthened granules of the dispersed phase will have an increased resistance to collapse during consolidating of the blend. The granules of the dispersed phase can be partially or fully sintered at temperatures ranging from about 400° C. to about 1300° C., depending on the desired strength of the dispersed phase. The granules can be sintered by a variety of means, such as, but not limited to, hydrogen sintering and vacuum sintering. Sintering of the granules can cause removal of lubricant, oxide reduction, densification, and microstructure development. The methods of partial or full sintering of the dispersed phase granules prior to blending result in a reduction in the collapse of the dispersed phase during blend consolidation.

Certain embodiments of articles according to the present disclosure include a second region comprising a metallic material that is one of a metal and a metal alloy wherein the second region includes at least one mechanical attachment feature or other mechanical feature. A mechanical attachment feature, as used herein, enables certain articles according to the present disclosure to be connected to certain other articles and function as part of a larger device. Mechanical attachment features can include, for example, threads, slots, keyways, clamping regions, teeth or cogs, steps, bevels, bores, pins, and/or arms. It has not previously been possible to successfully include such mechanical attachment features on articles formed solely from cemented hard particles for certain demanding applications because of the limited tensile strength and notch sensitivity of cemented hard particle materials. Prior art articles have included a metal or metal alloy region including one or more mechanical attachment features that were coupled to a cemented hard particle region by means other than co-pressing and sintering. Such prior art articles suffered from a relatively weak bond between the metal or metal alloy and the cemented hard particle region, severely limiting the possible applications of the articles.

The process for manufacturing cemented hard particle material parts typically comprises blending or mixing powdered ingredients including hard particles and a powdered binder to form a metallurgical powder blend. The metallurgical powder blend can be consolidated or pressed to form a green compact. The green compact is then sintered to form the article or a portion of the article. According to one process, the metallurgical powder blend is consolidated by mechanically or isostatically compressing to form the green compact, typically at pressures between 10,000 and 60,000 psi. In certain cases, the green compact can be pre-sintered at a temperature between about 400° C. and 1200° C. to form a "brown" compact. The green or brown compact is subsequently sintered to autogenously bond together the metallurgical powder particles and further densify the compact. In certain non-limiting embodiments, the powder compact can be sintered in vacuum or in hydrogen. In certain non-limiting embodiments, the compact is over pressure sintered at 300-2000 psi and at a temperature of 1350-1500° C. Subsequent to sintering, the article can be appropriately machined to form the desired shape or other features of the particular geometry of the article.

Embodiments of the present disclosure include methods of making a composite sintered powder metal article. One such method includes placing a first metallurgical powder into a first region of a void of a mold, wherein the first powder includes hard particles and a powdered binder. A second metallurgical powder blend is placed into a second region of the void of the mold. The second powder can include at least one of a metal powder and a metal alloy powder selected from the group consisting of a steel powder, a nickel powder, a nickel alloy powder, a molybdenum powder, a molybdenum alloy powder, a titanium powder, a titanium alloy powder, a cobalt powder, a cobalt alloy powder, a tungsten powder, and a tungsten alloy powder. The second powder can contact the first powder, or initially can be separated from the first powder in the mold by a separating means. Depending on the number of cemented hard particle and metal or metal alloy regions desired in the composite article, the mold can be partitioned into or otherwise include additional regions in which additional metallurgical powder blends can be disposed. For example, the mold can be segregated into regions by placing one or more physical partitions in the void of the mold to define the several regions and/or by merely filling regions of the mold with different powders without providing partitions between adjacent powders. The metallurgical powders are chosen to achieve the desired properties of the corresponding regions of the article as described herein. The materials used in the embodiments of the methods of this disclosure can comprise any of the materials discussed herein, but in powdered form, such that they can be pressed and sintered. Once the powders are loaded into the mold, any partitions are removed and the powders within the mold are then consolidated to form a green compact. The powders can be consolidated, for example, by mechanical or isostatic compression. The green compact can then be sintered to provide a composite sintered powder metal article including a cemented hard particle region formed from the first powder and metallurgically bonded to a second region formed from the second, metal or metal alloy powder. For example, sintering can be performed at a temperature suitable to autogenously bond the powder particles and suitably densify the article, such as at temperatures up to 1500° C.

The conventional methods of preparing a sintered powder metal article can be used to provide sintered articles of various shapes and including various geometric features. Such conventional methods will be readily known to those having ordinary skill in the art. Those persons, after considering the present disclosure, can readily adapt the conventional methods to produce composites articles according to the present disclosure.

A further non-limiting embodiment of a method according to the present disclosure comprises consolidating a first metallurgical powder in a mold to form a first green compact, and placing the first green compact in a second mold, wherein the first green compact fills a portion of the second mold. The second mold can be at least partially filled with a second metallurgical powder. The second metallurgical powder and the first green compact can be consolidated to form a second green compact. Finally, the second green compact is sintered to further densify the compact and to form a metallurgical bond between the region of the first metallurgical powder and the region of the second metallurgical powder. If necessary, the first green compact can be presintered up to a temperature of about 1200° C. to provide additional strength to the first green compact. Such embodiments of methods according to the present disclosure provide increased flexibility in design of the different regions of the composite article, for particular applications. The first green compact can be designed in any desired shape from any desired powder metal material according to the embodiments herein. In addition, the process can be repeated as many times as desired, preferably prior to sintering. For example, after consolidating to form the second green compact, the second green compact can be placed in a third mold with a third metallurgical powder and consolidated to form a third green compact. By such a repetitive process, more complex shapes can be formed. Articles including multiple clearly defined regions of differing properties can be formed. For example, a composite article of the present disclosure can include cemented hard particle materials where increased wear resistance properties, for example, are desired, and a metal or metal alloy in article regions at which it is desired to provide mechanical attachment features.

Certain embodiments of the methods according to the present disclosure are directed to composite sintered powder metal articles. As used herein, a composite article is an object that comprises at least two regions, each region composed of a different material. Composite sintered powder metal articles according to the present disclosure include at least a first region, which includes cemented hard particles, metallurgically bonded to a second region, which includes at least one of a metal and a metal alloy.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

EXAMPLE 1

Two non-limiting exemplary embodiments of composite articles according to the present disclosure are shown in FIG. 1. FIG. 1 shows cemented carbide-metallic composite articles 100, 200 consisting of a cemented carbide portion 110, 210 metallurgically bonded to a nickel portion 112, 212 that were fabricated using the following method according to the present disclosure. A layer of cemented carbide powder (available commercially as FL30™ powder, from ATI Firth Sterling, Madison, Ala., USA) consisting of by weight 70% tungsten carbide, 18% cobalt, and 12% nickel was placed in a mold in contact with a layer of nickel powder (available commercially as Inco Type 123 high purity nickel from Inco Special Products, Wyckoff, N.J., USA) and co-pressed to form a single green compact consisting of two distinct layers of consolidated powder materials. The pressing (or consolidation) was performed in a 100 ton hydraulic press employing a pressing pressure of approximately 20,000 psi. The resulting green compact was a cylinder approximately 1.5 inches in diameter and approximately 2 inches long. The cemented carbide layer was approximately 0.7 inches long, and the nickel layer was approximately 1.3 inches long. Following pressing, the composite compact was sintered in a vacuum furnace at 1380° C. During sintering the compact's linear shrinkage was approximately 18% along any direction. The composite sintered articles were ground on the outside diameter, and threads were machined in the nickel portion 212 of one of the articles. FIG. 1B is a photomicrograph showing the microstructure of articles 100 and 200 at the interface of the cemented carbide material 300 and nickel material 301. FIG. 1B clearly shows the cemented carbide and nickel portions metallurgically bonded together at interface region 302. No cracks were apparent in the interface region.

EXAMPLE 2

Figure 2:
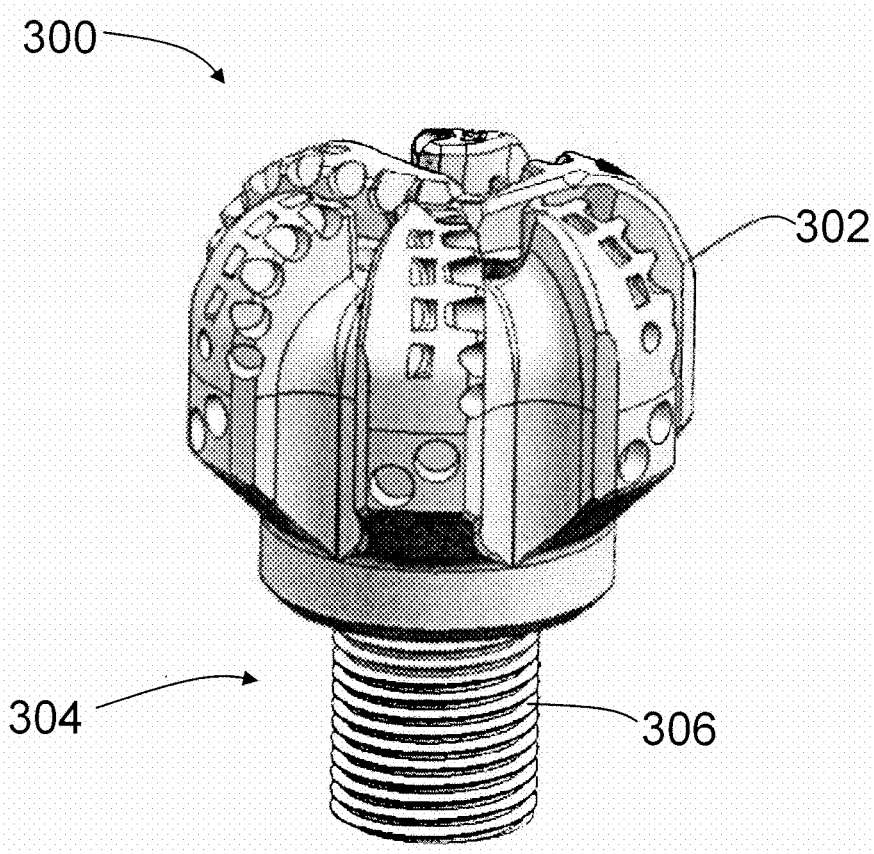
FIG. 2 is a schematic representation of a non-limiting embodiment of a composite sintered powder metal earth boring article according to the present disclosure comprising a composite sintered powder metal fixed cutter earth boring bit.

According to a non-limiting aspect of the present disclosure, a composite sintered powder metal article can be or comprise an earth boring article. Referring to FIG. 2, a non-limiting embodiment of a composite sintered powder metal earth boring article according to the present disclosure comprises a fixed cutter earth boring bit 300. The fixed cutter earth boring bit 300 comprises a first region 302 that is a working region. As used herein, a "working region" refers to a region of an article adapted to achieve the desired utility of the article, such as, for example, earth-boring, metalcutting, metalforming, and the like. The first region 302 comprises a cemented hard particle material that can be, for example, a cemented carbide. The first region 302 includes typical features such as, for example, pockets in which earth boring inserts can be attached. The first region 302 is directly metallurgically bonded to a second region 304 that is a metallic region comprising a metallic material that is one of a metal and a metal alloy. The second region 304 includes mechanical attachment features in the form of threads 306. In a non-limiting embodiment, the second region 304 comprises a metallic material such as, for example, a steel alloy. The threads 306 of the second region 304 are adapted to attach the fixed cutter earth boring bit 300 to a drill string (not shown). The second region 304 can comprise any suitable metal or metal alloy as disclosed herein. The second region 304 includes from 0 up to 30 percent by volume of hard particles. The second region 304 also can include any one or more of the mechanical attachment features disclosed herein in place of or together with threads 306 and that are adapted to suitably attach the bit 300 to a drill string. The construction of the fixed cutter earth boring bit 300 so as to include a cemented hard particle material first region 302 that is a working region, which is directly metallurgically bonded to a threaded second region 304 that is a metallic material, as depicted in FIG. 2, negates the need to use welding to attach an attachment region to a working region, avoiding the problems associated with welding. Such problems include the formation of cracks in the weld region due to the significantly different rates at which the cemented hard particle working region and the metal or metal alloy attachment region expand and contract during the heat-up and cool-down inherent in the welding process. The fixed cutter earth boring bit first region 302 that is a working region can be fabricated from metallurgical powders using methods as described herein and as otherwise known to those having ordinary skill in the art. For example, methods of forming a fixed cutter earth boring bit from cemented hard particles is disclosed in U.S. Pat. No. 7,954,569, the entire disclosure of which is hereby incorporated herein by reference.

In non-limiting embodiments, the first region 302 of a composite sintered powder metal fixed cutter earth boring bit 300 is comprised of a pressed and sintered metallurgical powder that comprises hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the first region 302 comprises 20 to 40 percent by volume of the binder phase and 60 to 80 percent by volume of hard particles.

In a certain non-limiting embodiment of a method of manufacturing a composite sintered powder metal fixed cutter earth boring bit, the metallurgical powder of the first region 302 is FL30™ powder from ATI Firth Sterling, Madison, Ala., USA. FL30™ powder includes by weight 70 percent tungsten carbide, 18 percent cobalt, and 12 percent nickel. The steel alloy powder of the second region 304 consists of by weight 94 percent Ancormet® 101 sponge iron powder (available commercially from Hoeganaes, Cinnaminson, N.J., USA), 4.0 percent high purity (99.9%) copper powder (available commercially from American Elements, Los Angeles, Calif., USA), 2.0 percent nickel (available commercially as Inco Type 123 high purity nickel from Inco Special Products, Wyckoff, N.J., USA), and 0.4% graphite powder (available as FP-161 from Graphite Sales, Inc., Chagrin Falls, Ohio, USA). A first region of an appropriately shaped mold is filled with the FL30™ powder to form the first region 302, and a second region of the mold is filled with the steel alloy powder having the composition provided above to form the second region 304. The processing conditions are the same as those disclosed in Example 1, hereinabove. After pressing and sintering, the metallic region comprising the steel alloy is machined to include threads.

EXAMPLE 3

Figure 3:
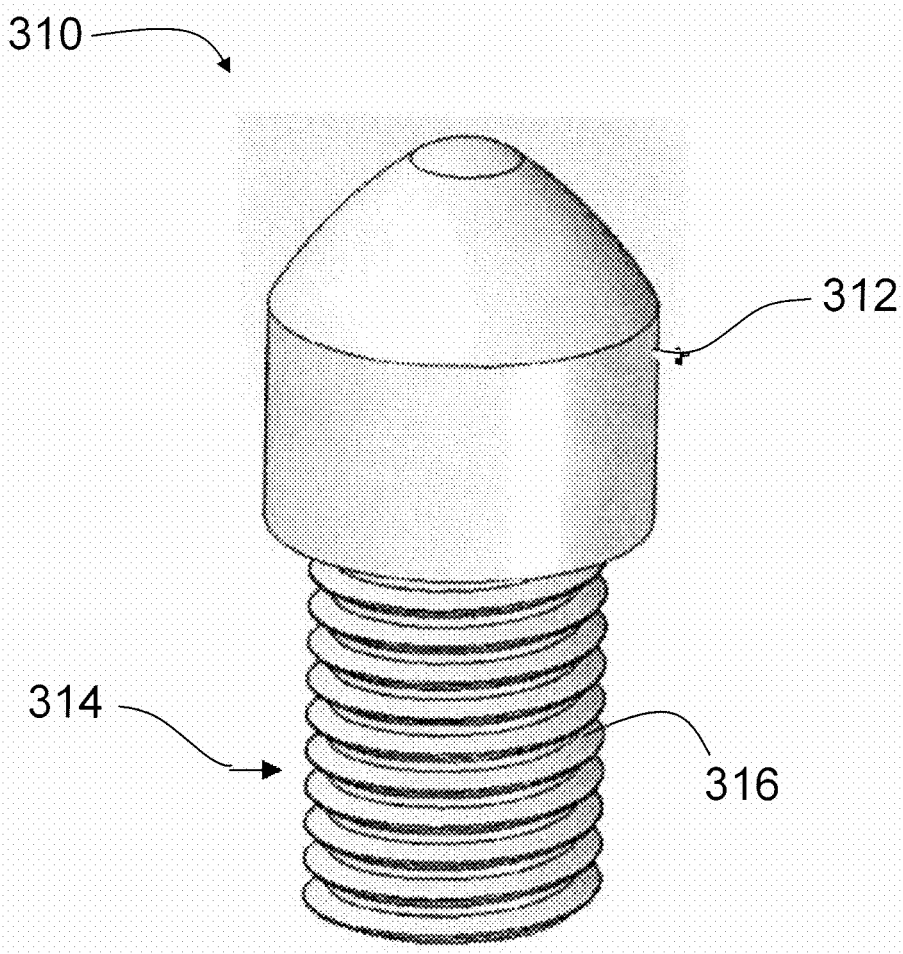
FIG. 3 is a schematic representation of a non-limiting embodiment of a composite sintered powder metal earth boring article according to the present disclosure comprising a composite sintered powder metal insert for rotary cone earth boring bits.

Referring to FIG. 3, another non-limiting embodiment of a composite sintered powder metal article according to the present disclosure comprises a composite sintered powder metal earth boring insert 310 for a rotary cone earth boring bit (not shown). The general construction of a rotary cone earth boring bit is known to those having ordinary skill and is not described herein. The composite sintered powder metal earth boring insert 310 for a rotary cone earth boring bit comprises a first region 312 that is a working region and includes a cemented hard particle material that can be, for example, a cemented carbide. The first region 312 is directly metallurgically bonded to a second region 314 that is a metallic region comprising a metallic material that is one of a metal and a metal alloy. The second region 314 includes mechanical attachment features in the form of threads 316. In a certain non-limiting embodiment, the metallic material of the second region 314 is a steel alloy. However, it will be understood that the second region 314 can comprise any other suitable metal or metal alloy, as disclosed herein. The second region 314 includes from 0 up to 30 percent by volume of hard particles. Also, it will be understood that the second region 314 of the earth boring insert 310 can include any suitable one of the mechanical attachment features disclosed herein in place of or together with threads 316. The construction of earth boring insert 310 so as to include a cemented hard particle material first region 312 that is a working region, which is directly metallurgically bonded to a threaded second region 314 that is a metallic region, as depicted in FIG. 3, allows for the insert 310 to be threadedly attached within a threaded bore provided in a steel cone (not shown) of a rotary cone earth boring bit.

In non-limiting embodiments, the first region 312 of a composite sintered powder metal earth boring insert 310 is comprised of a pressed and sintered metallurgical powder that includes: hard particles comprising at least one of carbide particles, nitride particles, boride particles, silicide particles, oxide particles, and solid solutions thereof; and a binder phase comprising at least one of cobalt, a cobalt alloy, molybdenum, a molybdenum alloy, nickel, a nickel alloy, iron, and an iron alloy. In a certain non-limiting embodiment, the working region comprises 10 to 25 percent by volume of the binder phase and 75 to 90 percent by volume of hard particles.

In certain non-limiting embodiments of a method of manufacturing a composite sintered powder metal fixed cutter earth boring bit according to the present disclosure, the metallurgical powder of the first region 312 is Grade 231, or Grade 941, or Grade 55B powder from ATI Firth Sterling, Madison, Ala., USA. Grade 231 powder includes by weight 90 percent tungsten carbide and 10 percent cobalt. Grade 941 powder includes by weight 89 percent tungsten carbide and 11 percent cobalt. Grade 55B powder includes by weight 84 percent tungsten carbide and 16 percent cobalt. The steel alloy powder of the second region 314 is the same as in Example 2. A first region of an appropriately shaped mold is filled with the Grade 231, or Grade 941, or Grade 55B powder to form the first region 312, and a second region of the mold is filled with the steel alloy powder to form the second region 314. The processing conditions are the same as those disclosed in Example 1, hereinabove. After pressing and sintering, the second region 314 comprising the steel alloy is machined to include threads.

Conventional cemented carbide cutting inserts for conventional rotary cone earth boring bits are press fit into insert pockets in steel cones that form a part of the bit assembly. In the event that one or more of the conventional inserts break or prematurely wear during the drilling process, the entire earth boring bit (which includes the bit body and the cutting inserts attached to it) must be scrapped, even though the remaining inserts suffer no breakage or unacceptable wear. The entire conventional drill bit is scrapped because once conventional cutting inserts have been attached onto steel cones of a conventional rotary cone earth boring bit, it is extremely difficult to remove and replace the cutting inserts. Embodiments of cutting inserts 310 according to the present disclosure, which include a threaded second region 314, which is a metallic region directly bonded to a cemented hard particle material first region 312, which is a working region, may be screwed into or out of threaded receptacles in the steel cones of the bit, making replacement of individual cutting inserts 310 relatively simple and negating the need to discard the entire earth boring bit if a cutting insert wears or breaks. The composite sintered powder metal cutting insert 310 can be fabricated from metallurgical powders using methods as described herein and as otherwise known to those having ordinary skill in the art.

While FIGS. 2 and 3 depict particular non-limiting embodiments of earth boring articles according to the present disclosure, it will be understood that other earth boring articles are within the scope of the present disclosure. Other composite sintered powder metal earth boring articles within the scope of the present disclosure include, but are not limited to, a fixed cutter earth boring bit, a cutting insert for a rotary cone earth boring bit, a nozzle for a rotary cone earth boring bit, a nozzle for an earth boring percussion bit, a gage brick, a polycrystalline diamond compact (PDC) substrate, and a coal pick. Each such sintered powder metal earth boring article includes a first region that is a working region comprising a cemented hard particle material and that is directly metallurgically bonded to a second region that is a metallic region comprising a metallic material that is one of a metal and a metal alloy. The second region includes at least one attachment feature adapted to attach the earth boring article to another article using the attachment feature.

EXAMPLE 4

Figure 4:
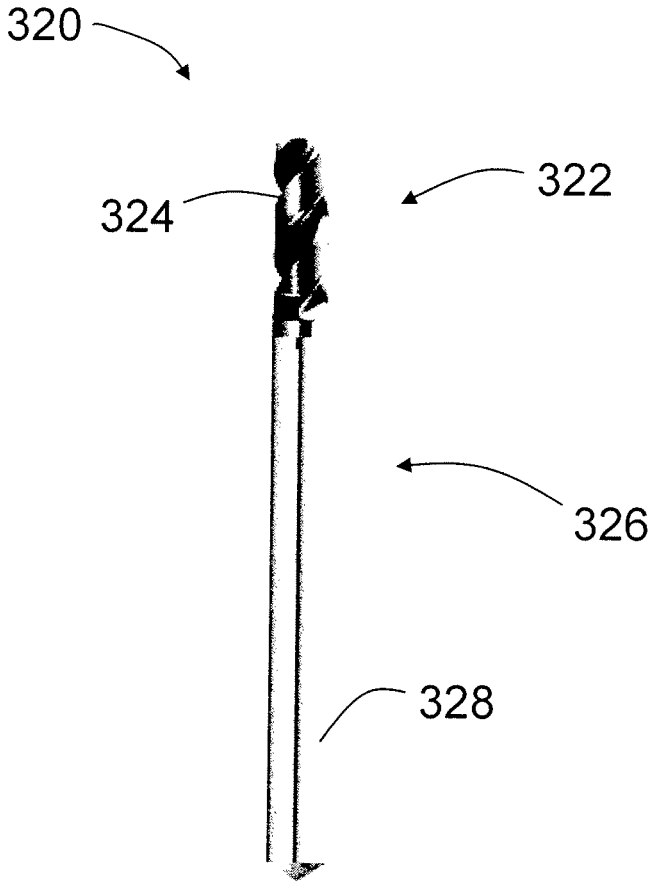
FIG. 4 is a schematic representation of a non-limiting embodiment of a composite sintered powder metal metalcutting article according to the present disclosure comprising a composite sintered powder metal drill bit.

According to another non-limiting aspect of the present disclosure, a composite sintered powder metal article comprises a composite sintered powder metal metalcutting tool. Referring to FIG. 4, a non-limiting embodiment of a composite sintered powder metal metalcutting tool comprises a composite sintered powder metal metalcutting drill bit 320. The drill bit 320 comprises a first region 322 that is a working region comprising a cemented hard particle material that may be, for example, a cemented carbide and that includes cutting edges 324. The first region 322 is directly metallurgically bonded to a second region 326 that is a metallic region comprising a metallic material that is one of a metal and a metal alloy and also comprising a mechanical attachment feature in the form of a clamping region 328 adapted to clamp the drill bit 320 into a tool holder (not shown). In a certain non-limiting embodiment, the second region 326 comprises a steel alloy. It will be recognized that the second region 326 can comprise any suitable metal or metal alloy as disclosed herein, and the second region 326 of the drill bit 320 can include any of the mechanical attachment features disclosed herein, in place of or together with the clamping region 328. The second region 326 includes from 0 up to 30 percent by volume of hard particles. The composite sintered powder metal metalcutting drill bit 320 can be fabricated from metallurgical powders using methods as described herein and as otherwise known to those having ordinary skill in the art.

In non-limiting embodiments, the first region 322, which is a working region of a composite sintered powder metal metalcutting drill bit 320 is comprised of a pressed and sintered metallurgical powder that comprises hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the first region 322 comprises 10 to 25 percent by volume of the binder phase and 75 to 90 percent by volume of hard particles.

In certain non-limiting embodiments of a method of manufacturing a composite sintered powder metal metalcutting drill bit, the metallurgical powder of the first region 322 that is a working region is Grade H17, or Grade FR10, or Grade FR15 powder from ATI Firth Sterling, Madison, Ala., USA. Grade H17 powder includes by weight 90 percent tungsten carbide and 10 percent cobalt. Grade FR10 includes by weight 90 percent tungsten carbide and 10 percent carbon. FR15 powder includes by weight 85 percent tungsten carbide and 15 percent cobalt. The steel alloy powder of the second region 326 is the same as the steel alloy powder from Example 2. A first region of an appropriately shaped mold is filled with the Grade H17, or Grade FR10, or Grade FR15 powder to form the first region 322, and a second region is filled with the steel alloy powder to form the second region 326. The processing conditions are the same as those disclosed in Example 1, hereinabove. After pressing and sintering, the second region 326 comprising the steel alloy serves as a clamping region for attaching to a drill.

Currently, metalcutting drill bits are often made from a solid piece of cemented carbide. The actual working portion of the drill bit that needs to be highly wear resistant is relatively small and may be, for example, on the order of about 0.25 to 0.5 inch (0.635 to 1.27 cm) in length. The remainder of the drill bit provides support to the drilling portion. The construction of a composite sintered powder metal metalcutting drill bit 320 that includes a first region 322, which is a working region including a cemented hard particle material and cutting edges 324, directly metallurgically bonded to a second region 324 that is a metallic region comprising a metallic material that is one of a metal and a metal alloy and having a clamping region 326, as depicted in FIG. 4, can significantly reduce costs associated with drilling operations. The cost of the a composite sintered powder metal metalcutting drill bit 320 is reduced relative to a conventional monolithic drill bit by providing a relatively short first region 322 that is a working region including, for example, a suitably hard and wear resistant cemented hard particle material, that is directly metallurgically bonded to a longer, less expensive second region 326 that is a metallic region comprising a metallic material that is one of a metal and a metal alloy and that provides support for the first region 322 and is provided with an attachment feature for attaching the composite sintered powder metal metalcutting drill bit 320 to a tool holder or a drill. It will be recognized that any effective length for the first region 322 and the second region 326 may be employed and that such designs are within the scope of the present disclosure.

EXAMPLE 5

Figure 5:
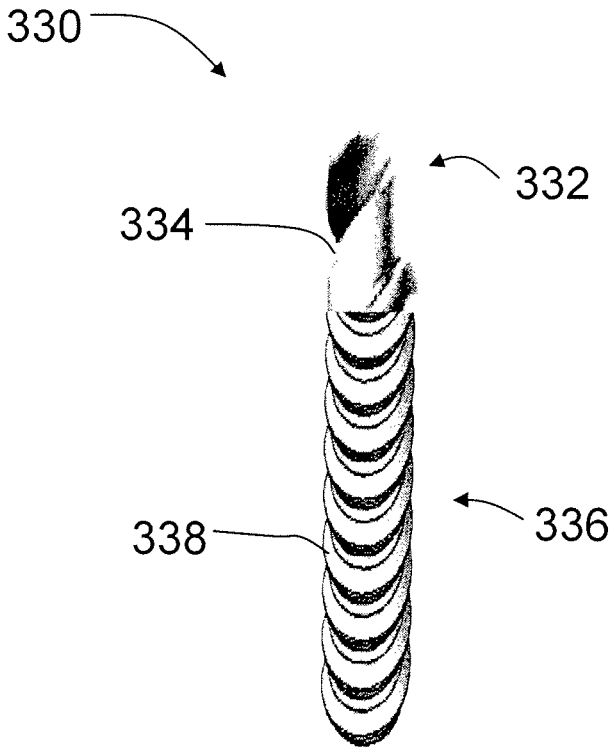
FIG. 5 is a schematic representation of a non-limiting embodiment of a composite sintered powder metal metalcutting article according to the present disclosure comprising a composite sintered powder metal modular metalcutting drill bit.

Referring to FIG. 5, a non-limiting aspect of a composite sintered powder metal metalcutting tool according to the present disclosure comprises a modular metalcutting drill bit 330. The modular metalcutting drill bit 330 comprises a first region 332 in the form of a working region comprising a cemented hard particle material and including cutting edges 334. The first region 332 that is working region is metallurgically bonded to a second region 336 that is a metallic region including at least one a metal or metal alloy and comprising an attachment feature in the form of threads 338 adapted to threadedly attach the modular metalcutting drill bit 330 to a shank (not shown). In a non-limiting embodiment, the second region 336 comprises a steel alloy. However, it will be understood that the second region 336 can comprise any metal or metal alloy as disclosed herein. The second region 336 includes from 0 up to 30 percent by volume of hard particles. It also will be understood that the second region 336 of the composite sintered powder metal modular metalcutting drill bit 330 can include any of the mechanical attachment features disclosed herein that are suitable, in place of or together with threads 338. The composite sintered powder metal modular metalcutting drill bit 330 can be fabricated from metallurgical powders using methods as described herein and as otherwise known to those having ordinary skill in the art.

In non-limiting embodiments, the first region 332 that is a working region of a composite sintered powder metal modular metalcutting drill bit 330 is comprised of a pressed and sintered metallurgical powder that comprises hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the first region 332 comprises 10 to 25 percent by volume of the binder phase and 75 to 90 percent by volume of hard particles.

In certain non-limiting embodiments of a method of manufacturing a composite sintered powder metal modular metalcutting drill bit, the metallurgical powder of the first region 332 is Grade H17, or Grade FR10, or Grade FR15 powder from ATI Firth Sterling, Madison, Ala., USA (see above). The steel alloy powder of the second region 336 is the same as the steel alloy powder in Example 2. A first region of an appropriately shaped mold is filled with the Grade H17, or Grade FR10, or Grade FR15 powder to form the first region 332, and a second region is filled with the steel alloy powder to form the second region 336. The processing conditions are the same as those disclosed in Example 1, hereinabove. After pressing and sintering, the second region 336 formed from the steel alloy powder is machined to include threads.

As discussed above, metal cutting drills are typically made from solid cemented carbide, which is an expensive material relative to many metals and metal alloys. The design of the composite sintered powder metal modular metalcutting drill bit 330 shown in FIG. 5 permits the use of a relatively small cemented hard particle first region 332 that is a working region having a cutting edge 334 and that is directly metallurgically bonded to a relatively large and less expensive second region 336 that is a metallic region comprising threads 338. The cost of metalcutting drill bits can thus be reduced substantially. The threaded portion can then be fastened to a machine tool shank. In addition, the second region 336 can be readily machined to provide the threads or other attachment features. In contrast, the machining of cemented hard particle materials is much more difficult.

While FIGS. 4 and 5 depict particular non-limiting embodiments of metalcutting articles according to the present disclosure, it is recognized that other metalcutting articles are within the scope of the present disclosure. Other composite sintered powder metal metalcutting articles within the scope of the present disclosure include, but are not limited to a milling tool, a modular milling tool, a turning tool, a shaping tool, a threading tool, a drilling tool, a hobbing and gear cutting tool, a tapping tool, a sawing tool, and a reaming tool. Each such composite sintered powder metal metalcutting article includes a first region that is a working region comprising a cemented hard particle material and that is directly metallurgically bonded to a second region that is a metallic region comprising a metallic material that is one of a metal and a metal alloy. The first region includes features to machine a workpiece. The second region includes at least one attachment feature adapted to attach the composite sintered powder metal metalcutting article to another article using the attachment feature.

EXAMPLE 6

Figure 6:
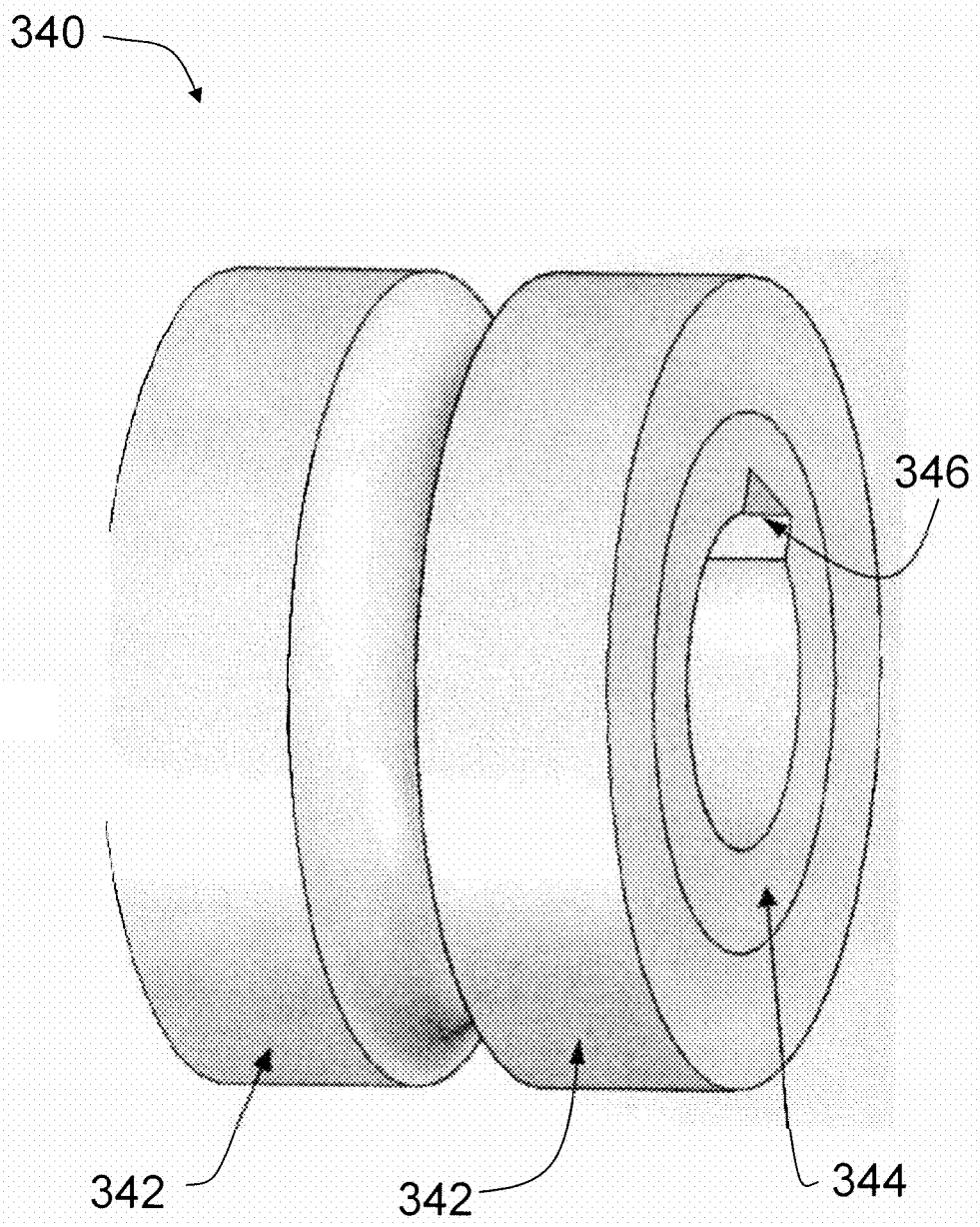
FIG. 6 is a schematic representation of a non-limiting embodiment of a composite sintered powder metal metal-forming article according to the present disclosure comprising a composite sintered powder metal mill roll.

According to another non-limiting aspect of the present disclosure, a composite sintered powder metal article comprises a composite sintered powder metal metalforming tool. Referring to FIG. 6, a non-limiting embodiment of a composite sintered powder metal metalforming tool according to the present disclosure comprises a composite sintered powder metal mill roll 340. The composite sintered powder metal mill roll 340 can be used, for example, for the hot rolling of steel bar and rod. The composite sintered powder metal mill roll 340 comprises a first region 342 that is a working region for rolling metals and metal alloys. The first region 342 comprises a cemented hard particle material that may be, for example, a cemented carbide. The first region 342 is metallurgically bonded to a second region 344 that is a metallic region comprising a metallic material including one of a metal and a metal alloy and that supports the first region 342. As depicted in FIG. 6, the second region 344 can be adapted as an inner ring portion of the composite sintered powder metal mill roll 340 that supports an outer ring portion composed of the first region 342. The second region 344 comprises an attachment feature in the form of a keyway or slot 346 adapted to attach the mill roll 340 to a shaft or shafts (not shown) that drive the composite sintered powder metal mill roll 340 during a rolling process. In a non-limiting embodiment, the second region 344 comprises a steel alloy. However, it will be understood that the second region 344 can comprise any suitable metal or metal alloy as disclosed herein. The second region 344 includes from 0 up to 30 percent by volume of hard particles. It also will be understood that the second region 344 of the mill roll 340 can include any mechanical attachment feature as disclosed herein in place of or together with keyways or slots 346. The dimensions of mill rolls are well known to persons having ordinary skill in the art and can be configured to suit a specific need. As such, those details need not be disclosed herein. The composite sintered powder metal mill roll 340 can be fabricated from metallurgical powders using methods as described herein and as otherwise known to those having ordinary skill in the art.

In non-limiting embodiments, the first region 342 that is a working region of a composite sintered powder metal mill roll 340 is comprised of a pressed and sintered metallurgical powder that includes hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the first region 342 comprises 15 to 40 percent by volume of the binder phase and 60 to 85 percent by volume of hard particles.

In certain non-limiting embodiments of a method of manufacturing a composite sintered powder metal mill roll, the metallurgical powder of the first region 342 is Grade R61, or Grade H20, or Grade H25 powder from ATI Firth Sterling, Madison, Ala., USA. Grade R61 powder includes by weight 85 percent tungsten carbide and 15 percent cobalt. Grade H20 powder includes by weight 80 percent tungsten carbide and 20 percent cobalt. Grade H25 includes by weight 75 percent tungsten carbide and 25 percent cobalt. The steel alloy powder of the second region 344 is the same as the steel alloy powder in Example 2. A first region (or working region) of an appropriately shaped mold is filled with the Grade R61, or Grade H20, or Grade H25 powder to form the first region 342, and a second region of the mold is filled with the steel alloy powder to form the second region 344. The processing conditions are the same as those disclosed in Example 1, hereinabove. After pressing and sintering, the second region 344 comprising the steel alloy is machined to include at least one of a keyway and a slot.

Mill rolls for the hot rolling of bar and rod are often made from cemented carbides. Since cemented carbides are relatively brittle materials, it is typically not feasible to provide slots or keyways in rolls made from monolithic cemented carbides to enable the rolls to be attached to shafts for driving the rolls during the rolling process. For this reason, elaborate methods such as the use of hydraulically actuated expanding materials, for example, are typically used to drive monolithic cemented carbide mill rolls. These techniques can result in premature breakage of the mill rolls if the hoop stress levels are too high, or can result in slippage of the mill rolls if the hydraulic forces are too low.

The problems described are addressed by certain non-limiting embodiments according to the present disclosure such as the composite sintered powder metal mill roll 340 illustrated in FIG. 6, which comprises a cemented Hard particle material first region 342 that is a working region for rolling a metal or metal alloy and a second region 344 that is a metallic region to support and provide features adapted to allow the mill roll to be driven during use. For example, the second region 344 may be machined to incorporate attachment features such as keyways and slots 346 that can be used to attach the composite sintered powder metal mill roll 340 to, for example, a shaft that selectively rotates and positively drives the composite sintered powder metal mill roll 340.

EXAMPLE 7

Figure 7:
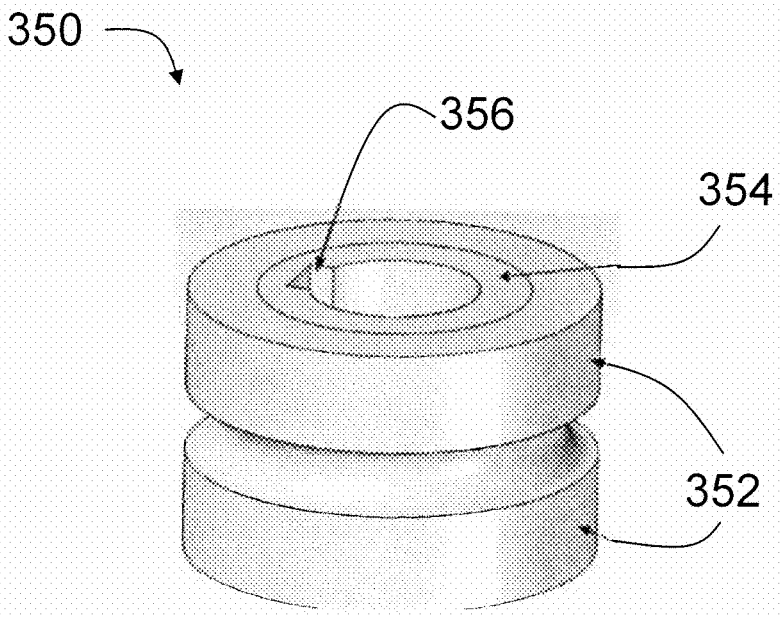
FIG. 7 is a schematic representation of a non-limiting embodiment of a composite sintered powder metal metal-forming article according to the present disclosure comprising a composite sintered powder metal burnishing roll.

Referring to FIG. 7, a non-limiting embodiment of a composite sintered powder metal metalforming article according to the present disclosure comprises a composite sintered powder metal burnishing roll 350. As is known in the art, burnishing rolls may be used to burnish steel ball bearings to impart a polished finish on the bearings. Burnishing rolls are typically assembled onto a steel shaft and the roll is positively connected to the shaft by a keyway arrangement. As in the case of mill rolls discussed above, it typically is not feasible to provide keyways in relatively brittle cemented carbide materials. Therefore, burnishing rolls are typically made entirely from tools steel such as D-2 steel alloy.

Still referring to FIG. 7, a non-limiting embodiment of a composite sintered powder metal burnishing roll 350 according to the present disclosure comprises a first region 352 that is a working region for burnishing metals or metal alloys and that is metallurgically bonded to a second region 354 that is a metallic region comprising a metallic material including one of a metal and a metal alloy and that supports the first region 352. The second region 354 comprises an attachment feature that is a keyway or slot 356 adapted to allow the composite sintered powder metal burnishing roll 350 to be attached to a shaft (not shown) that selectively rotates to drive the composite sintered powder metal burnishing roll 350 during a burnishing process. The first region 352 comprises a cemented hard particle material that may be, for example, a cemented carbide. As depicted in FIG. 7, the second region 354 that is a metallic region can be adapted as an inner ring portion that supports an outer ring portion composed of the first region 352 that is a working region. In a non-limiting embodiment, the second region 354 comprises a steel alloy. It will be understood that the second region 354 can comprise any metal or metal alloy for a second region 354 as disclosed herein. The second region 354 includes from 0 up to 30 percent by volume of hard particles. It further will be understood that the second region 354 of the composite sintered powder metal burnishing roll 350 can include any of the mechanical attachment features disclosed herein, in place of or together with keyways or slots 356. The dimensions and other features of burnishing rolls 350 are understood by those having ordinary skill in the art and, therefore, need not be disclosed herein. The composite sintered powder metal burnishing roll 350 can be fabricated from metallurgical powders using methods as described herein and as otherwise known to those having ordinary skill in the art.

In non-limiting embodiments, the first region 352 of a composite sintered powder metal burnishing roll 350 is comprised of a pressed and sintered metallurgical powder that comprises hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the working region comprises 15 to 40 percent by volume of the binder phase and 60 to 85 percent by volume of hard particles.

In certain non-limiting embodiments of a method of manufacturing a composite sintered powder metal burnishing roll 350, the metallurgical powder of the first region 352 is Grade R61, or Grade H20, or Grade H25 powder from ATI Firth Sterling, Madison, Ala., USA (see above). The steel alloy powder of the second region 354 comprises the same steel alloy powder as in Example 2. A first region of an appropriately shaped mold is filled with the Grade R61, or Grade H20, or Grade H25 powder to form the first region 352, and a second region is filled with the steel alloy powder to form the second region 354. The processing conditions are the same as those disclosed in Example 1, hereinabove. After pressing and sintering, the metallic region comprising the steel alloy is machined to include at least one of a keyway and a slot.

While FIGS. 6 and 7 depict particular non-limiting embodiments of metalforming articles according to the present disclosure, it is recognized that other metalforming articles are within the scope of the present disclosure. Other composite sintered powder metal metalforming articles within the scope of the present disclosure include, but are not limited to a wire-drawing die, a tube drawing die, a bar drawing die, a heading die, a powder compacting die, a progression die, a lamination die, a punching die, an extrusion die, a hot forging die, a cold forging die, a peeling die, a trimming die, a nail-gripper die, a spring forming die, a wire forming die, a swaging die, a wire flattening die, a wire flattening roll, a mandrel, a tube drawing plug, a can forming die, a roll for hot rolling of metals, and a roll for cold rolling of metals. Each such sintered powder metal metalforming article includes a first region that is a working region comprising a cemented hard particle material and that is metallurgically bonded to a second region that is a metallic region comprising a metallic material that is one of a metal and a metal alloy. The second region includes at least one attachment feature adapted to attach the metalforming article to another article using the attachment feature.

EXAMPLE 8

Figure 8:
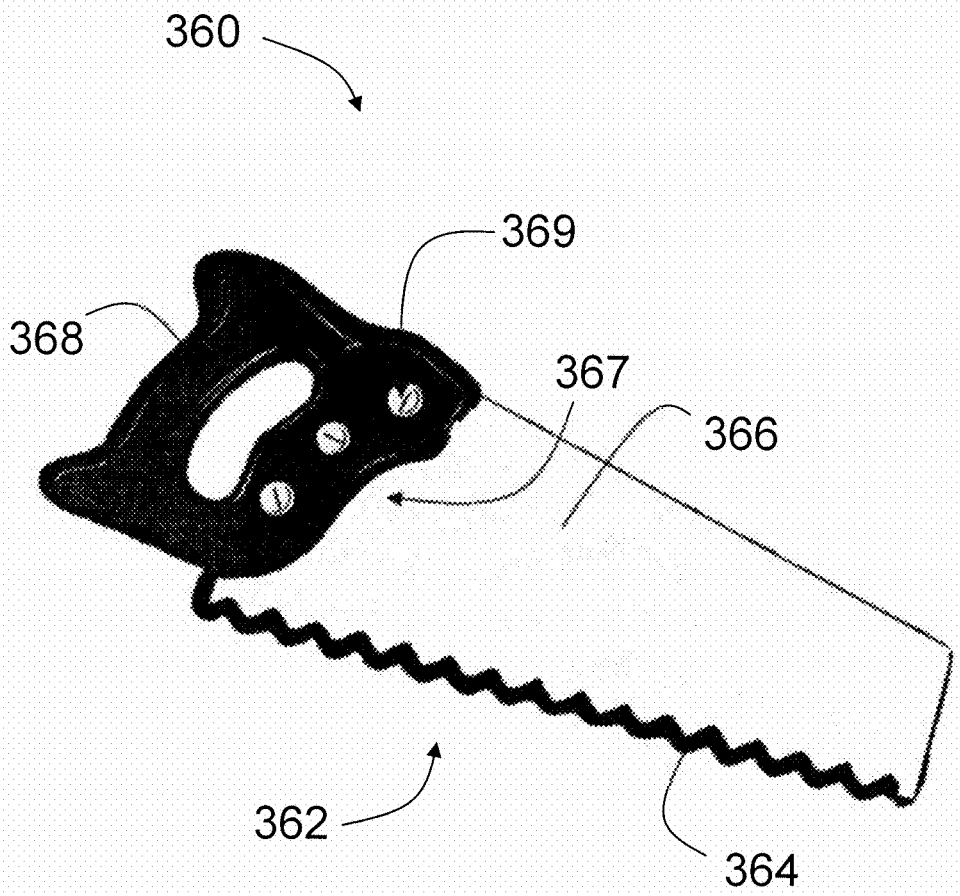
FIG. 8 is a schematic representation of a non-limiting embodiment of a composite sintered powder metal woodworking article according to the present disclosure comprising a composite sintered powder metal woodcutting saw blade.

According to another non-limiting aspect of the present disclosure, a composite sintered powder metal article comprises a composite sintered powder metal woodworking tool. Referring to FIG. 8, a non-limiting embodiment of a composite sintered powder metal woodworking tool comprises a composite sintered powder metal woodcutting saw blade 360. The composite sintered powder metal woodcutting saw blade 360 comprises a first region 362 that is a working region including cutting teeth 364 and comprising a cemented hard particle material that may be, for example, a cemented carbide. The first region 362 is directly metallurgically bonded to a second region 366 that is a metallic region comprising a metallic material that is at least one of a metal and a metal alloy. The second region 366 comprises an attachment feature in the form of an attachment region 367 adapted with slots (not shown), for example, to attach the saw blade 360 to a saw handle 368 using, for example, bolts 369. In a non-limiting embodiment, the second region 366 comprises a steel alloy. However, it will be understood that the second region 366 can comprise any metal or metal alloy as disclosed herein. The second region 366 includes from 0 up to 30 percent by volume of hard particles. It will further be understood that the second region 366 of the composite sintered powder metal woodcutting saw blade 360 can include any suitable mechanical attachment feature disclosed herein, in place of or together with the attachment region 367 with slots (not shown). The composite sintered woodcutting saw blade 360 illustrated in FIG. 8 includes a relatively small cemented hard particle material first region 362, which is a working region that includes saw teeth 364, directly metallurgically bonded to a second region 366 that can be produced from significantly less expensive material, including one of a metal and a metal alloy, while still providing the mechanical properties needed to withstand the forces generated during the sawing operation. This construction can provide a significant cost savings relative to producing the entire saw blade from cemented carbide or other cemented hard particle material. The composite sintered powder metal woodcutting saw blade 360 can be fabricated from metallurgical powders using methods as described herein and as otherwise known to those having ordinary skill in the art.

In non-limiting embodiments, the first region 362 of a composite sintered powder metal woodworking tool, exemplified as a composite sintered powder metal woodcutting saw blade 360 is comprised of a pressed and sintered metallurgical powder that comprises hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the first region 362 comprises 6 to 20 percent by volume of the binder phase and 80 to 94 percent by volume of hard particles.

In certain non-limiting embodiments of a method of manufacturing a composite sintered powder metal woodworking tool, the metallurgical powder of the first region 362 is HU6C or H17 powder from ATI Firth Sterling, Madison, Ala., USA. Grade HU6C powder includes by weight 94 percent tungsten carbide and 6% cobalt. Grade H17 powder includes by weight 90 percent tungsten carbide and 10 percent cobalt. The steel alloy powder of the second region 366 is the same as the steel alloy powder of Example 2. A first region of an appropriately shaped mold is filled with the HU6C or H17 powder to form the first region 362, and a second region of the mold is filled with the steel alloy powder to form the second region 366. The processing conditions are the same as those disclosed in Example 1, hereinabove. After pressing and sintering, the metallic region comprising the steel alloy is machined to include at least one of threads, slots, and holes for bolting the saw blade to a handle.

While FIG. 8 depicts a particular non-limiting embodiment of a composite sintered powder metal woodworking tool according to the present disclosure, it is recognized that other composite sintered powder metal woodworking tools are within the scope of the present disclosure. Other composite sintered powder metal woodworking tools within the scope of the present disclosure include, but are not limited to a plane iron and a router. Each such composite sintered powder metal woodworking tool includes a first region that is a working region comprising a cemented hard particle material and that is directly metallurgically bonded to a second region that is a metallic region comprising a metallic material that is one of a metal and a metal alloy. The metallic region includes at least one attachment feature adapted to attach the tool to another article using the attachment feature.

EXAMPLE 9

Figure 9:
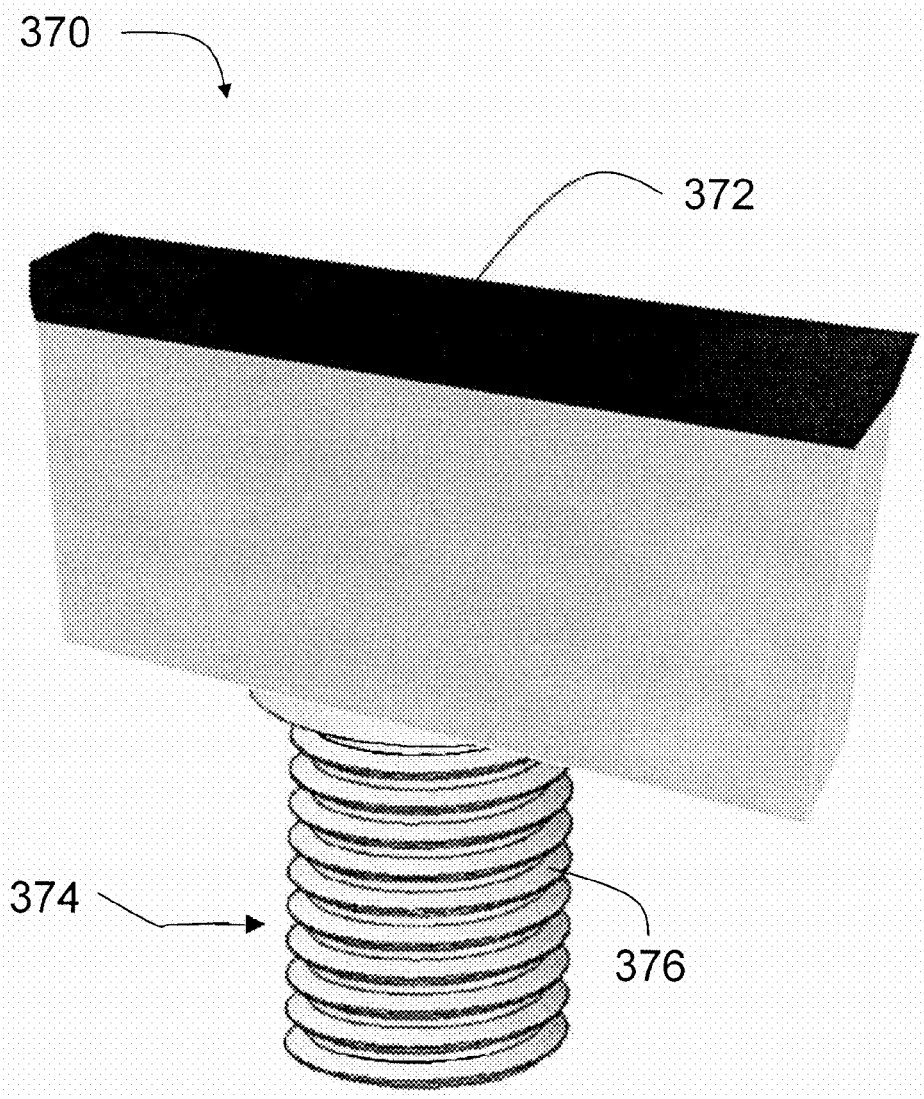
FIG. 9 is a schematic representation of a non-limiting embodiment of a composite sintered powder metal wear article according to the present disclosure comprising a composite sintered powder metal anvil.

According to yet another aspect of the present disclosure, a non-limiting embodiment of a composite sintered powder metal article comprises a composite sintered powder metal wear article. Referring to FIG. 9, a non-limiting embodiment of a composite sintered powder metal wear article is in the form of a composite sintered powder metal anvil 370. The composite sintered powder metal anvil 370 comprises a first region 372 that is a wear region comprising a cemented hard particle material that may be, for example, a cemented carbide. The term "wear region" refers to the portion of a composite sintered metal article according to certain non-limiting embodiments of the present disclosure that will be subject to wear during use, such as, for example a wear surface. The first region 372 that is a wear region is directly metallurgically bonded to a second region 374 that is a metallic region comprising a metallic material including one of a metal and a metal alloy and comprising threads 376 adapted to threadedly attach the composite sintered powder metal anvil 370 to a tool holder (not shown) or other article. In a certain non-limiting embodiment, the second region 374 comprises a steel alloy. However, it will be understood that the second region 374 can comprise any suitable metal or metal alloy for a second region 374 as disclosed herein. The second region 374 includes from 0 up to 30 percent by volume of hard particles. In addition, it will be understood that the second region 374 of the anvil 370 can include any of the mechanical attachment features disclosed herein, in place of or together with the threads 376. The metallic material of the second region 374 may be machined readily to provide threads or other attachment features, which provides a convenient means of attaching the composite sintered powder metal anvil 370 to a tool holder or other article. Given that the use of relatively expensive cemented hard particle material may be limited to the wear region 372 of the composite sintered powder metal anvil 370, the composite sintered powder metal anvil 370 may be significantly less expensive to produce than an anvil composed entirely of cemented carbide. The composite sintered powder metal anvil 370 can be fabricated from metallurgical powders using methods as described herein and as otherwise known to those having ordinary skill in the art.

In non-limiting embodiments, the first region 372, which is a wear region of a composite sintered powder metal anvil 370 is comprised of a metallurgical powder that comprises hard particles comprising at least one of carbide particles, nitride particles, boride particles, silicide particles, oxide particles, and solid solutions thereof; and a binder phase of the cemented hard particle material comprising at least one of cobalt, a cobalt alloy, molybdenum, a molybdenum alloy, nickel, a nickel alloy, iron, and an iron alloy. In a certain non-limiting embodiment, the first region 372 comprises 10 to 30 percent by volume of the binder phase and 70-90 percent by volume of hard particles.

In certain non-limiting embodiments of a method of manufacturing a composite sintered powder metal anvil 370, the metallurgical powder of the first region 372 is MPD10, or MPD2C, or R61 powder from ATI Firth Sterling, Madison, Ala., USA. Grade MPD10 powder includes by weight 90 percent tungsten carbide and 10 percent by weight cobalt. Grade MPD2C powder includes by weight 88.5 percent tungsten carbide and 11.5 percent cobalt. Grade R61 powder includes by weight 85 percent tungsten carbide and 15 percent cobalt. The steel alloy powder of the second region 374 comprises the same steel alloy powder as in Example 2. A first region of an appropriately shaped mold is filled with the MPD10, or MPD2C, or R61 powder to form the first region 372, and a second region of the mold is filled with the steel alloy powder to form the second region 374. The processing conditions are the same as those disclosed in Example 1, hereinabove. After pressing and sintering, the second region 374 comprising the steel alloy is machined to include threads for attaching the anvil 370 to another article.

While FIG. 9 depicts a particular non-limiting embodiment of a composite sintered powder metal wear article according to the present disclosure, it is recognized that other composite sintered powder metal wear articles are within the scope of the present disclosure. Other composite sintered powder products within the scope of the present disclosure that may be considered wear articles include, but are not limited to a die for diamond synthesis, a shot blast nozzle, a paint nozzle, a boring bar, a slitting knife, a seal ring, a valve component, a plug gauge, a slip gauge, a ring gauge, a ball for an oil pump, a seat for an oil pump, a trim component for oilfield applications, and a choke component for oilfield applications. A person having ordinary skill understands the location of the wear region on the recited wear articles, and the recited wear articles need not be described further herein. Each such sintered powder metal wear article includes a first region that is a wear region comprising a cemented hard particle material and that is directly metallurgically bonded to a second region that is a metallic region comprising a metallic material that is one of a metal and a metal alloy. The second region includes at least one attachment feature adapted to attach the wear article to another article using the attachment feature.

EXAMPLE 10

Figure 10:
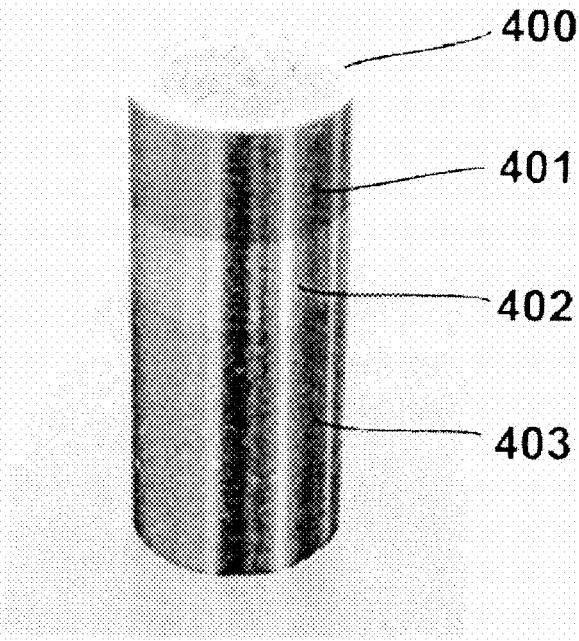
FIG. 10 illustrates one non-limiting embodiment of a three-layer composite sintered powder metal article according to the present disclosure, wherein the composite includes a cemented carbide region, a nickel region, and a steel region.

FIG. 10 shows a cemented carbide-metal alloy composite article 400 that was fabricated by powder metal pressing and sintering techniques according to the present disclosure and included three separate layers. The first layer 401 consisted of cemented carbide formed from FL30™ (see above). The second layer 402 consisted of nickel formed from nickel powder, and the third layer 403 consisted of steel formed from a steel powder. The method employed for fabricating the composite was essentially identical to the method employed in Example 1 except that three layers of powders were co-pressed together to form the green compact, instead of two layers. The three layers appeared uniformly metallurgically bonded together to form the composite article. No cracks were apparent on the exterior of the sintered article in the vicinity of the interface between the cemented carbide and nickel regions.

EXAMPLE 11

Figure 11:
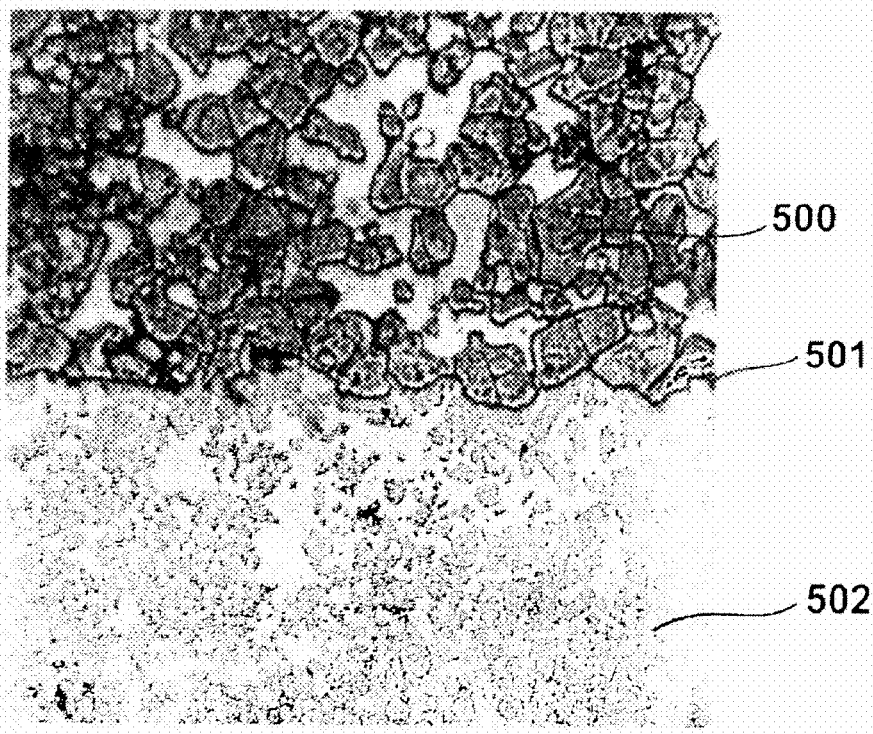
FIG. 11 is a photomicrograph of a cross-section of a region of a composite sintered powder metal article according to the present disclosure, wherein the composite includes a cemented carbide region and a tungsten alloy region, and wherein the figure depicts the metallurgical bond region of the composite. The grains visible in the tungsten alloy portion are grains of pure tungsten. The grains visible in the cemented carbide region are grains of cemented carbide.

A composite article consisting of a cemented carbide portion and a tungsten alloy portion was fabricated according to the present disclosure using the following method. A layer of cemented carbide powder (FL30™ powder) was disposed in a mold in contact with a layer of tungsten alloy powder (consisting of 70% tungsten, 24% nickel, and 6% copper) and co-pressed to form a single composite green compact consisting of two distinct layers of consolidated powders. The pressing (or consolidation) was performed in a 100 ton hydraulic press employing a pressing pressure of approximately 20,000 psi. The green compact was a cylinder approximately 1.5 inches in diameter and approximately 2 inches long. The cemented carbide layer was approximately 1.0 inches long and the tungsten alloy layer was also approximately 1.0 inches long. Following pressing, the composite compact was sintered at 1400° C. in hydrogen, which minimizes or eliminates oxidation when sintering tungsten alloys. During sintering, the compact's linear shrinkage was approximately 18% along any direction. FIG. 11 illustrates the microstructure which clearly shows the cemented carbide 502 and tungsten alloy 500 portions metallurgically bonded together at the interface 501. No cracking was apparent in the interface region.

Although the foregoing description has necessarily presented only a limited number of embodiments, those of ordinary skill in the relevant art will appreciate that various changes in the subject matter and other details of the examples that have been described and illustrated herein can be made by those skilled in the art, and all such modifications will remain within the principle and scope of the present disclosure as expressed herein and in the appended claims. For example, although the present disclosure has necessarily only presented a limited number of embodiments of rotary burrs constructed according to the present disclosure, it will be understood that the present disclosure and associated claims are not so limited. Those having ordinary skill will readily identify additional composite sintered powder metal articles along the lines and within the spirit of the necessarily limited number of embodiments discussed herein. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

What is claimed is:

1. A composite sintered powder metal earth boring article, comprising:
- a first region comprising a cemented hard particle material; and
- a second region comprising
  - a metallic material selected from the group consisting of a steel, nickel, a nickel alloy, titanium, a titanium alloy, molybdenum, a molybdenum alloy, cobalt, a cobalt alloy, tungsten, and a tungsten alloy, and
  - from 0 up to 30 percent by volume of hard particles;
- wherein the first region is metallurgically bonded to the second region;
- wherein each of the first region and the second region has a thickness greater than 100 microns; and
- wherein the second region comprises at least one mechanical attachment feature adapted to attach the composite sintered powder metal earth boring article to another article.

2. The composite sintered powder metal earth boring article of claim 1, wherein the at least one mechanical feature comprises at least one of a thread, a slot, a keyway, a clamping region, a tooth, a cog, a step, a bevel, a bore, a pin, and an arm.

3. The composite sintered powder metal earth boring article of claim 1, wherein the earth boring article comprises at least one of a fixed cutter earth boring bit, an earth boring insert for a rotary cone earth boring bit, a nozzle for a rotary cone earth boring bit, a nozzle for an earth boring percussion bit, a gage brick, a polycrystalline diamond compact (PDC) substrate, and a coal pick.

4. The composite sintered powder metal earth boring article of claim 1, wherein:
- the composite sintered powder metal earth boring article comprises a fixed cutter earth boring bit; and
- the first region comprises a fixed cutter earth boring bit body region.

5. The composite sintered powder metal earth boring article of claim 4, wherein the mechanical attachment feature of the second region comprises a threaded region.

6. The composite sintered powder metal earth boring article of claim 1, wherein:
- the composite sintered powder metal earth boring article comprises an earth boring insert; and
- the first region comprises a working region.

7. The composite sintered powder metal earth boring article of claim 6, wherein the mechanical attachment feature of the second region comprises a threaded region.

8. The composite sintered powder metal earth boring article of claim 1, wherein the second region comprises up to 20 percent by volume hard particles.

9. The composite sintered powder metal earth boring article of claim 1, wherein the second region comprises 2 to 20 percent by volume hard particles.

10. The composite sintered powdered metal earth boring article of claim 1, wherein the metallurgical bond establishes a crack free interface between the first region and second region.

11. A composite sintered powder metal metalcutting tool, comprising:
- a first region comprising a cemented hard particle material; and
- a second region comprising
  - a metallic material selected from the group consisting of a steel, nickel, a nickel alloy, titanium, a titanium alloy, molybdenum, a molybdenum alloy, cobalt, a cobalt alloy, tungsten, and a tungsten alloy, and from 0 up to 30 percent by volume of hard particles;

wherein the first region is metallurgically bonded to the second region;

wherein each of the first region and the second region has a thickness greater than 100 microns; and wherein the second region comprises at least one mechanical attachment feature adapted to attach the composite sintered powder metal metalcutting tool to another article.

12. The composite sintered powder metal metalcutting tool of claim 11, wherein the at least one mechanical feature comprises at least one of a thread, a slot, a keyway, a clamping region, a tooth, a cog, a step, a bevel, a bore, a pin, and an arm.

13. The composite sintered powder metal metalcutting tool of claim 11, wherein the metalcutting tool comprises at least one of a metal cutting drill, a modular metal cutting drill, a milling tool, a modular milling tool, a turning tool, a shaping tool, a threading tool, a drilling tool, a hobbing and gear cutting tool, a tapping tool, a sawing tool, and a reaming tool.

14. The composite sintered powder metal metalcutting tool of claim 11, wherein:

the composite sintered powder metal metalcutting tool comprises a metalcutting drill bit; and the first region comprises a working region.

15. The composite sintered powder metal metalcutting tool of claim 14, wherein the mechanical attachment feature of the second region comprises a clamping region adapted to be clamped in a tool holder.

16. The composite sintered powder metal metalcutting tool of claim 11, wherein:

the composite sintered powder metal metalcutting tool comprises a modular metalcutting drill bit; and the first region comprises a working region.

17. The composite sintered powder metal metalcutting tool of claim 16, wherein the mechanical attachment feature of the second region comprises a threaded region.

18. The composite sintered powder metal metalcutting tool of claim 11, wherein the second region comprises up to 20 percent by volume hard particles.

19. The composite sintered powder metal metalcutting tool of claim 11, wherein the second region comprises 2 to 20 percent by volume hard particles.

20. The composite sintered powder metal metalcutting tool of claim 11, wherein the metallurgical bond establishes a crack free interface between the first region and second region.

21. A composite sintered powder metal metalforming tool, comprising:

a first region comprising a cemented hard particle material; and a second region comprising a metallic material selected from the group consisting of a steel, nickel, a nickel alloy, titanium, a titanium alloy, molybdenum, a molybdenum alloy, cobalt, a cobalt alloy, tungsten, and a tungsten alloy, and from 0 up to 30 percent by volume of hard particles; wherein the first region is metallurgically bonded to the second region;

wherein each of the first region and the second region has a thickness greater than 100 microns; and wherein the second region comprises at least one mechanical attachment feature adapted to attach the composite sintered powder metal metalforming tool to another article.

22. The composite sintered powder metal metalforming tool of claim 21, wherein the at least one mechanical feature comprises at least one of a thread, a slot, a keyway, a clamping region, a tooth, a cog, a step, a bevel, a bore, a pin, and an arm.

23. The composite sintered powder metal metalforming tool of claim 21, wherein the metalforming tool comprises at least one of a mill roll, a burnishing roll, a wire-drawing die, a tube drawing die, a bar drawing die, a heading die, a powder compacting die, a progression die, a lamination die, a punching die, an extrusion die, a hot forging die, a cold forging die, a peeling die, a trimming die, a nail-gripper die, a spring forming die, a wire forming die, a swaging die, a wire flattening die, a wire flattening roll, a mandrel, a tube drawing plug, a can forming die, a roll for hot rolling of metals, and a roll for cold rolling of metals.

24. The composite sintered powder metal metalforming tool of claim 21, wherein:

the composite sintered powder metal metalforming tool comprises a mill roll; and the first region comprises a working region.

25. The composite sintered powder metal metalforming tool of claim 24, wherein the mechanical attachment feature of the second region comprises at least one of a keyway and a slot.

26. The composite sintered powder metal metalforming tool of claim 21, wherein:

the composite sintered powder metal metalforming tool comprises a burnishing roll; and the first region comprises a working region.

27. The composite sintered powder metal metalforming tool of claim 26, wherein the mechanical attachment feature of the second region comprises at least one of a keyway and a slot.

28. The composite sintered powder metal metalforming tool of claim 21, wherein the second region comprises up to 20 percent by volume hard particles.

29. The composite sintered powder metal metalforming tool of claim 21, wherein the second region comprises 2 to 20 percent by volume hard particles.

30. The composite sintered powder metal metalforming tool of claim 21, wherein the metallurgical bond establishes a crack free interface between the first region and second region.

31. A composite sintered powder metal woodworking tool, comprising:

a first region comprising a cemented hard particle material; and a second region comprising a metallic material selected from the group consisting of a steel, nickel, a nickel alloy, titanium, a titanium alloy, molybdenum, a molybdenum alloy, cobalt, a cobalt alloy, tungsten, and a tungsten alloy, and from 0 up to 30 percent by volume of hard particles;

wherein the first region is metallurgically bonded to the second region;

wherein each of the first region and the second region has a thickness greater than 100 microns; and wherein the second region comprises at least one mechanical attachment feature adapted to attach the sintered powder metal woodworking tool to another article.

32. The composite sintered powder metal woodworking tool of claim 31, wherein the at least one mechanical feature comprises at least one of a thread, a slot, a keyway, a clamping region, a tooth, a cog, a step, a bevel, a bore, a pin, and an arm.

33. The composite sintered powder metal woodworking tool of claim 31, wherein the woodworking tool comprises one of a woodcutting saw, a plane iron, and a router.

34. The composite sintered powder metal woodworking tool of claim 31, wherein:

the composite sintered powder metal woodworking tool comprises a woodcutting saw; and the first region comprises a working region.

35. The composite sintered powder metal woodworking tool of claim 34, wherein the mechanical attachment feature of the second region comprises at least one of a thread and a slot.

36. A composite sintered powder metal wear article, comprising:

a first region comprising a cemented hard particle material; and a second region comprising a metallic material selected from the group consisting of a steel, nickel, a nickel alloy, titanium, a titanium alloy, molybdenum, a molybdenum alloy, cobalt, a cobalt alloy, tungsten, and a tungsten alloy, and from 0 up to 30 percent by volume of hard particles; wherein the first region is metallurgically bonded to the second region;

wherein each of the first region and the second region has a thickness greater than 100 microns; and wherein the second region comprises at least one mechanical attachment feature adapted to attach the composite sintered powder metal wear article to another article.

37. The composite sintered powder metal wear article of claim 36, wherein the at least one mechanical feature comprises at least one of a thread, a slot, a keyway, a clamping region, a tooth, a cog, a step, a bevel, a bore, a pin, and an arm.

38. The composite sintered powder metal wear article of claim 36, wherein the wear article comprises a least one of an anvil, a die for diamond synthesis, a shot blast nozzle, a paint nozzle, a boring bar, a slitting knife, a seal ring, a valve component, a plug gauge, a slip gauge, a ring gauge, a ball for an oil pump, a seat for an oil pump, a trim component for oilfield applications, and a choke component for oilfield applications.

39. The composite sintered powder metal wear article of claim 36, wherein:

the composite sintered powder metal wear article comprises an anvil; and the first region comprises a working region adapted to be a wear region.

40. The composite sintered powder metal wear article of claim 36, wherein the mechanical attachment feature of the second region comprises a threaded region.

41. The composite sintered powder metal wear article of claim 36, wherein the second region comprises up to 20 percent by volume hard particles.

42. The composite sintered powder metal wear article of claim 36, wherein the second region comprises 2 to 20 percent by volume hard particles.

43. The composite sintered powder metal wear article of claim 36, wherein the metallurgical bond establishes a crack free interface between the first region and second region.

* * * * *